US011910880B1

(12) United States Patent
Perkins

(10) Patent No.: US 11,910,880 B1
(45) Date of Patent: Feb. 27, 2024

(54) LACE LOCK SYSTEM

(71) Applicant: Alexander Perkins, Chesapeake, VA (US)

(72) Inventor: Alexander Perkins, Chesapeake, VA (US)

( * ) Notice: Subject to any disclaimer, the term of this patent is extended or adjusted under 35 U.S.C. 154(b) by 45 days.

(21) Appl. No.: 17/702,060

(22) Filed: Mar. 23, 2022

Related U.S. Application Data

(60) Provisional application No. 63/164,977, filed on Mar. 23, 2021.

(51) Int. Cl.
*A43C 7/00* (2006.01)
*A43C 11/14* (2006.01)

(52) U.S. Cl.
CPC ..... *A43C 11/14* (2013.01)

(58) Field of Classification Search
CPC ..... A43C 11/14
See application file for complete search history.

(56) References Cited

U.S. PATENT DOCUMENTS

| | | | | |
|---|---|---|---|---|
| 1,481,903 | A * | 1/1924 | Hart | A43C 7/00 24/132 R |
| 2,315,196 | A * | 3/1943 | Gallione | B65D 19/44 24/134 P |
| 5,097,573 | A * | 3/1992 | Gimeno | A43C 7/00 24/712.2 |
| 2006/0168784 | A1* | 8/2006 | Ahn | A43C 11/00 24/712.5 |
| 2011/0067211 | A1* | 3/2011 | Huber | A43C 7/08 24/712.1 |
| 2019/0380446 | A1* | 12/2019 | Jeon | A43C 7/00 |
| 2022/0125163 | A1* | 4/2022 | Pelkofer | A43C 7/04 |

* cited by examiner

*Primary Examiner* — Jason W San
(74) *Attorney, Agent, or Firm* — Shaddock Law Group, PC

(57) ABSTRACT

A lace lock including at least some of a lace lock base; a cam lock at least partially rotatable within a base cavity of the lace lock base; a fastener engaging a cam post of the lace lock base to maintain a lace lock cover in a position relative to the lace lock base; and a lace cord, wherein a distal end portion of the lace cord is attached or coupled to the lace lock base, wherein a proximal end portion of the lace cord is positioned through at least a portion of the lace lock base to selectively engage the cam lock if the cam lock is in the engaged position so that interaction between at least a camming surface of the cam lock resists a withdrawing force of the lace cord from the lace lock base.

20 Claims, 25 Drawing Sheets

LACE LOCK SYSTEM

CROSS-REFERENCE TO RELATED APPLICATIONS

This patent application claims the benefit of U.S. Patent Application Ser. No. 63/164,977, filed Mar. 23, 2021, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of shoe laces and shoe lace locking systems. More specifically, the present disclosure relates to a lace lock system.

2. Description of Related Art

It is generally known to lace shoes or boots using shoelaces, cords, or the like.

A tourniquet is generally a tightly tied band applied around a body part (for example, a bent or strap tightened around an arm or a leg by twisting) in an attempt to arrest bleeding by forcibly compressing blood vessels. A tourniquet typically comprises a tourniquet band and a windless and is typically applied as a last resort method when bleeding cannot be controlled through alternative methods and the amount of blood loss is likely to cause death in seconds to minutes.

When severe bleeding cannot be controlled by other means, a tourniquet may be the only way to save the life of an injured individual, time constraints might require the decision to be made by the injured person.

On the modern battlefield, for example, life-threatening bleeding from injuries to extremities is more common because modern body armor tends to protect the torso from such wounds. Blast injuries to limbs rarely result in a clean amputation or a salvageable limb, and rapid application of a tourniquet can be lifesaving when arterial bleeding results from such a major injury.

Approximately 70% of all preventable fatalities on the modern battlefield are the result of extremity trauma. Unfortunately, medical care is not always immediately available and an injured individual or someone within close proximity has to tend to their own or their teammate's wounds. This has been particularly true where use of improvised explosive devices has sharply increased. The users have armor that protects their torsos and to a lesser degree their heads; however, since the extremities are left unprotected the users are more likely to suffer a severe laceration in those extremities. The large loss of blood from these lacerations can be avoided with the quick application of a well-placed tourniquet.

It has been increasingly more common for military personnel and even civilians to carry a tourniquet as part of their individual first aid kits to control life-threatening extremity bleeding.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, it can be extremely time-consuming to fully lace and tie shoelaces or boot laces. Additionally, typical tourniquets and tourniquet assemblies can be bulky and difficult to carry in a convenient manner. Because no one knows when a tourniquet may be necessary, it is advantageous to always have a tourniquet present and ready for use.

In order to overcome these and other shortcomings of known shoelaces or boot laces into providing a readily available option tourniquet or tourniquet system, the lace lock of the present disclosure provides a lace lock assembly that can easily be integrated into a shoe, boot, or other item of clothing that includes a shoelace or portion of cord. In various exemplary embodiments, the lace lock assembly is removably integrated as a portion of an article of footwear. In a non-deployed configuration, the lace lock assembly may allow the shoestring or shoelaces to be quickly and easily tightened or loosened. In a deployed configuration, the lace lock is releasable from the item of footwear and the shoestring or shoelaces can be removed from the item of footwear and used as a tourniquet system.

When used as a tourniquet system, the lace lock assembly generally acts as the windless and windless lock of a traditional tourniquet and the shoestring or shoelaces acts as the tourniquet band.

In certain exemplary, nonlimiting embodiments, the lace lock of the present disclosure provides at least some of a lace lock base, wherein a base cavity is formed within at least a portion of the lace lock base, wherein a cam post extends within a portion of the lace lock base; a cam lock positioned within a base cavity of the lace lock base, wherein the cam lock is at least partially rotatable about at least a portion of the cam post between an engaged position and a disengaged position; a torsion spring biasing the cam lock to the engaged position; a lace lock cover, wherein the lace lock cover covers at least a portion of the lace lock base; a lace cord, wherein a distal end portion of the lace cord is attached or coupled to the lace lock base, wherein a proximal end portion of the lace cord is positioned through at least a portion of the lace lock base so as to selectively engage the cam lock if the cam lock is in the engaged position, and wherein if the cam lock is in the engaged position, interaction between at least a camming surface of the cam lock resists a withdrawing force of the lace cord from the lace lock base; and a coupling element, wherein the lace lock base is repeatably releasably attachable or couplable to the coupling element.

In certain exemplary, nonlimiting embodiments, at least a portion of a fastener is positioned through a fastener aperture of the lace lock cover to engage a cam post recess of the cam post and maintain the lace lock cover in a position relative to the lace lock base.

In certain exemplary, nonlimiting embodiments, the coupling element is attached or coupled to an item of footwear.

In certain exemplary, nonlimiting embodiments, the coupling element is repeatably releasably attachable or couplable to the lace lock base via interaction of one or more post tunnels formed through a portion of the base body and at least a portion of one or more corresponding coupling posts extending from a portion of the coupling element.

In certain exemplary, nonlimiting embodiments, at least a portion of a camming surface of the cam lock includes a textured portion.

In certain exemplary, nonlimiting embodiments, the lace lock of the present disclosure provides at least some of a lace lock base; a lace lock cover, wherein a cover cavity is formed in a portion of the lace lock cover, wherein a cam post extends within a portion of the cover cavity, wherein a cover exit slot is formed through a portion of a front wall of the lace lock cover and through a portion of a first sidewall of the lace lock cover, wherein a cover entry aperture is formed through a portion of a second sidewall of the lace lock cover, and wherein the lace lock cover covers at least a portion of the lace lock base; a cam lock positioned within the cover cavity of the lace lock cover, wherein the cam lock is at least partially rotatable about at least a portion of the cam post between an engaged position and a disengaged position; a lace cord, wherein a distal end portion of the lace cord is attached or coupled to the lace lock base, wherein a proximal end portion of the lace cord is positioned through at least a portion of the lace lock base so as to selectively engage the cam lock if the cam lock is in the engaged position, and wherein if the cam lock is in the engaged position, interaction between at least a camming surface of the cam lock resists a withdrawing force of the lace cord from the lace lock base; and a coupling element, wherein the lace lock base is repeatably releasably attachable or couplable to the coupling element.

In certain exemplary, nonlimiting embodiments, the coupling element is attached or coupled to an item of footwear.

In certain exemplary, nonlimiting embodiments, at least a portion of a camming surface of the cam lock includes a textured portion.

In certain exemplary, nonlimiting embodiments, a torsion spring biases the cam lock to the engaged position.

In certain exemplary, nonlimiting embodiments, at least a portion of a fastener is positioned through a fastener aperture of the lace lock base to engage a cam post recess of the cam post and maintain the lace lock cover in a position relative to the lace lock base.

In certain exemplary, nonlimiting embodiments, the lace lock cover is removably attached or coupled to the lace lock base via interaction of one or more cover coupling posts extending from the lace lock cover and one or more corresponding post tunnels formed within the lace lock base.

In certain exemplary, nonlimiting embodiments, one or more magnets are attached or coupled to the coupling element and wherein one or more corresponding magnets are attached or coupled to the lace lock base, wherein the one or more magnets of the coupling element and the one or more corresponding magnets of the lace lock base are positioned such that if the lace lock base is appropriately aligned with the coupling element, the lace lock base and the coupling element are magnetically releasably attached or coupled to one another.

In certain exemplary, nonlimiting embodiments, the lace lock of the present disclosure provides at least some of a lace lock base; a lace lock cover having a cover cavity formed in a portion of the lace lock cover, a cover cam post extending within a portion of the cover cavity, and the lace lock cover position so as to cover at least a portion of the lace lock base; a cam lock positioned within the cover cavity of the lace lock cover, the cam lock at least partially rotatable about at least a portion of the cover cam post between an engaged position and a disengaged position; a lace cord having a distal end portion attached or coupled to the lace lock base, having a proximal end portion positioned through at least a portion of the lace lock base so as to selectively engage the cam lock if the cam lock is in the engaged position such that if the cam lock is in the engaged position, interaction between at least a camming surface of the cam lock resists a withdrawing force of the lace cord from the lace lock base; and a coupling element repeatably releasably attachable or couplable to the lace lock base.

In certain exemplary, nonlimiting embodiments, the coupling element is attached or coupled to an item of footwear.

In certain exemplary, nonlimiting embodiments, at least a portion of a camming surface of the cam lock includes a textured portion.

In certain exemplary, nonlimiting embodiments, the cam lock is biased to the engaged position.

In certain exemplary, nonlimiting embodiments, a base cam post extends from the base body, wherein the base cam post extends such that when the lace lock base is aligned with the lace lock cover, the base cam post is aligned with the cover cam post to allow the cam lock to be rotatable or pivotable about a portion of the aligned base cam post and about a portion of the cover cam post.

In certain exemplary, nonlimiting embodiments, the lace lock cover is removably attached or coupled to the lace lock base via interaction of one or more cover coupling posts extending from the lace lock cover and one or more corresponding post tunnels formed within the lace lock base.

In certain exemplary, nonlimiting embodiments, one or more magnets are attached or coupled to the coupling element and wherein one or more corresponding magnets are attached or coupled to the lace lock base, wherein the one or more magnets of the coupling element and the one or more corresponding magnets of the lace lock base are positioned such that if the lace lock base is appropriately aligned with the coupling element, the lace lock base and the coupling element are magnetically releasably attached or coupled to one another.

In certain exemplary, nonlimiting embodiments, a cover exit slot is formed through a portion of a front wall of the lace lock cover and extends through a portion of a first sidewall of the lace lock cover, and wherein a cover entry aperture is formed through a portion of a second sidewall of the lace lock cover.

Accordingly, the present disclosure separately and optionally provides a lace lock that allows a tourniquet system to be easily and readily attached or coupled to an article of footwear.

The present disclosure separately and optionally provides a lace lock that provides a tourniquet system that can be quickly and easily deployed.

The present disclosure separately and optionally provides a lace lock that acts as a windless and windless lock.

The present disclosure separately and optionally provides a lace lock that can be used to tighten or loosen the shoestrings or shoelaces of an article of footwear.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
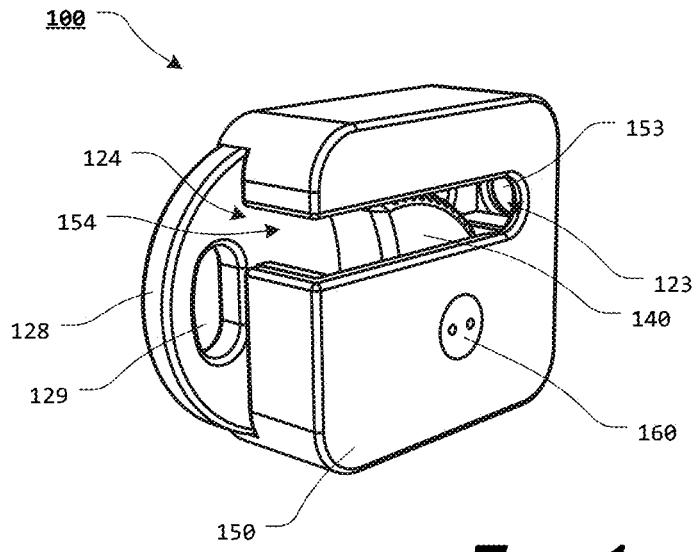
FIG. 1 illustrates a front, side perspective view of certain exemplary components of an exemplary embodiment of a lace lock assembly, according to the present disclosure.
Figure 2:
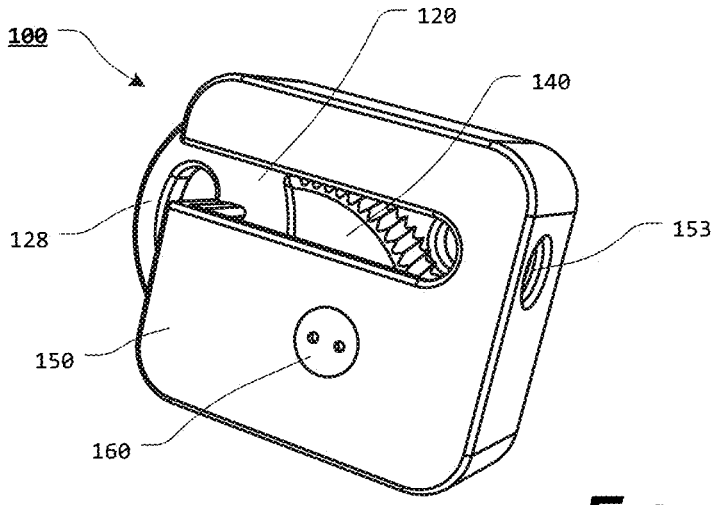
FIG. 2 illustrates a front, side perspective view of certain exemplary components of an exemplary embodiment of a lace lock assembly, according to the present disclosure.
Figure 3:
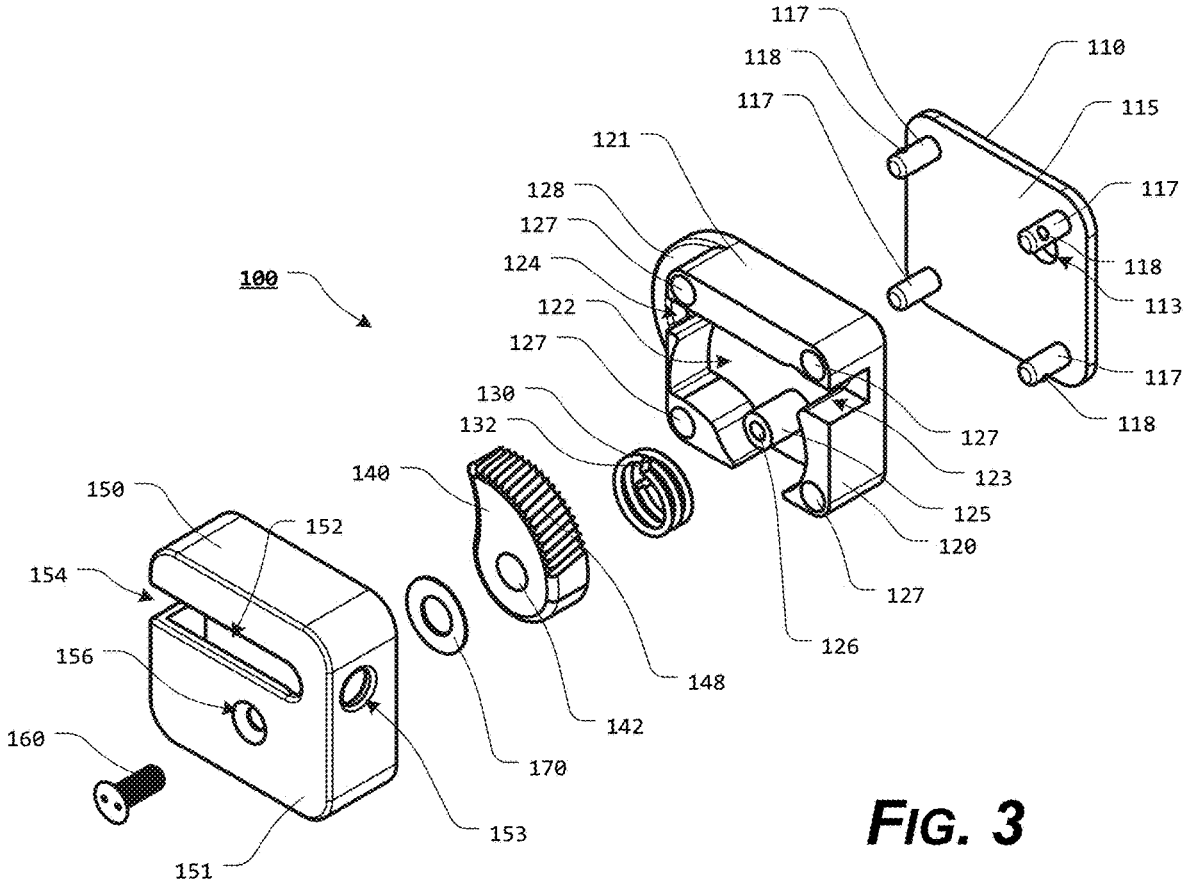
FIG. 3 illustrates an exploded view of certain exemplary components of an exemplary embodiment of a lace lock assembly, according to the present disclosure.
Figure 4:
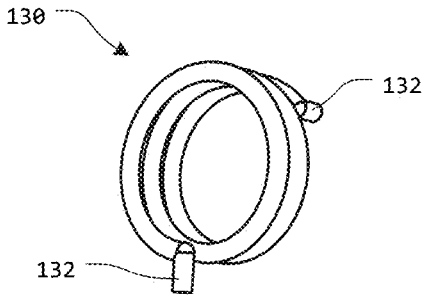
FIG. 4 illustrates a perspective view of an exemplary embodiment of a torsion spring of a lace lock assembly, according to the present disclosure.
Figure 5:
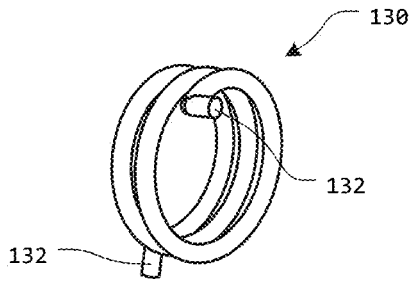
FIG. 5 illustrates a perspective view of an exemplary embodiment of a torsion spring of a lace lock assembly, according to the present disclosure.
Figure 6:
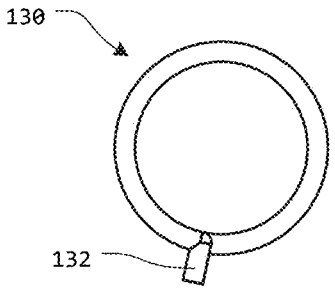
FIG. 6 illustrates a front view of an exemplary embodiment of a torsion spring of a lace lock assembly, according to the present disclosure.
Figure 7:
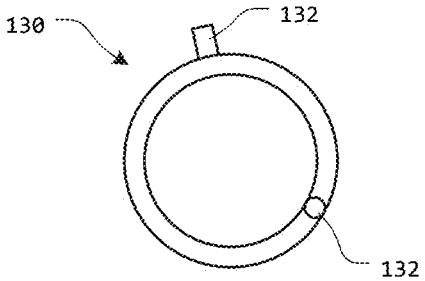
FIG. 7 illustrates a rear view of an exemplary embodiment of a torsion spring of a lace lock assembly, according to the present disclosure.
Figure 8:
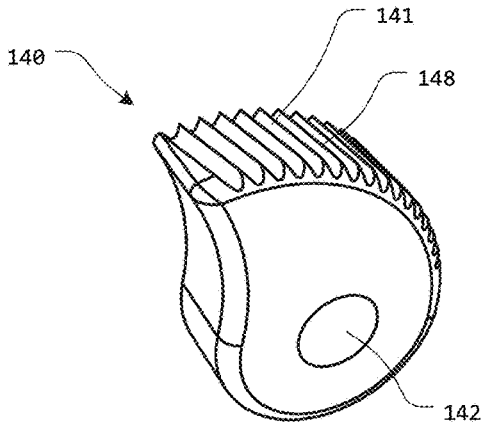
FIG. 8 illustrates a front perspective view of an exemplary embodiment of a cam lock of a lace lock assembly, according to the present disclosure.
Figure 9:
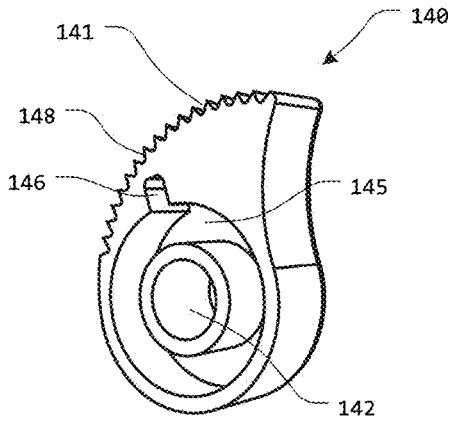
FIG. 9 illustrates a rear perspective view of an exemplary embodiment of a cam lock of a lace lock assembly, according to the present disclosure.
Figure 10:
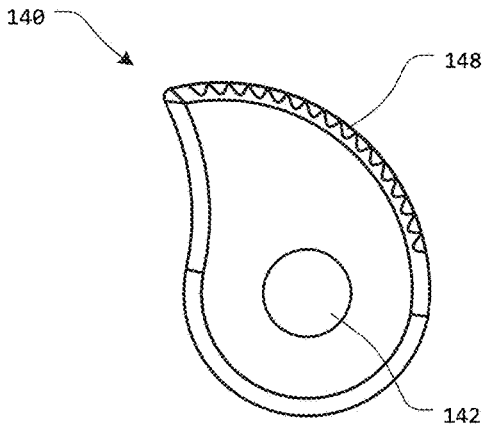
FIG. 10 illustrates a front view of an exemplary embodiment of a cam lock of a lace lock assembly, according to the present disclosure.
Figure 11:
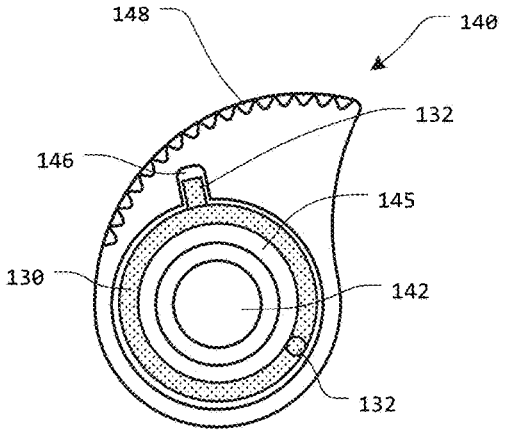
FIG. 11 illustrates a rear view of an exemplary embodiment of a cam lock of a lace lock assembly, according to the present disclosure.
Figure 12:
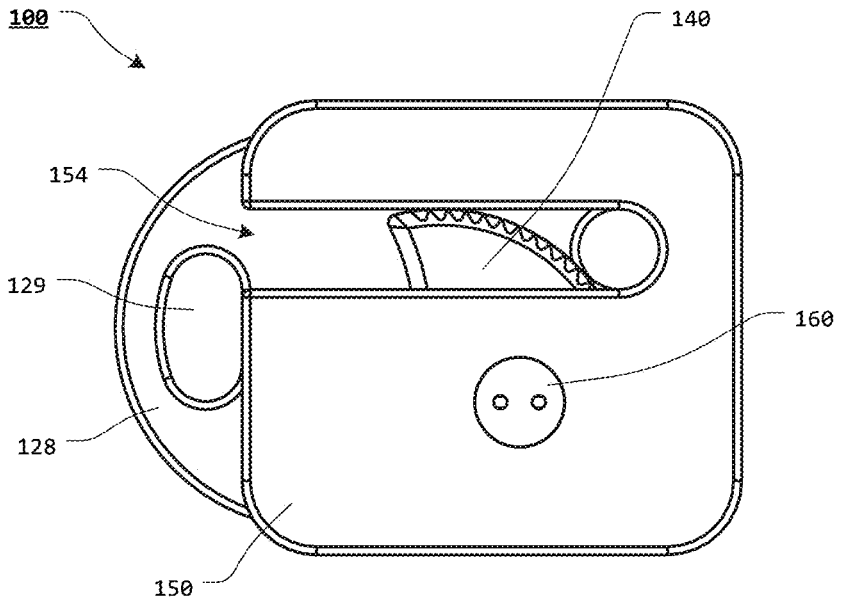
FIG. 12 illustrates a front view of certain exemplary components of an exemplary embodiment of a lace lock assembly, according to the present disclosure.
Figure 13:
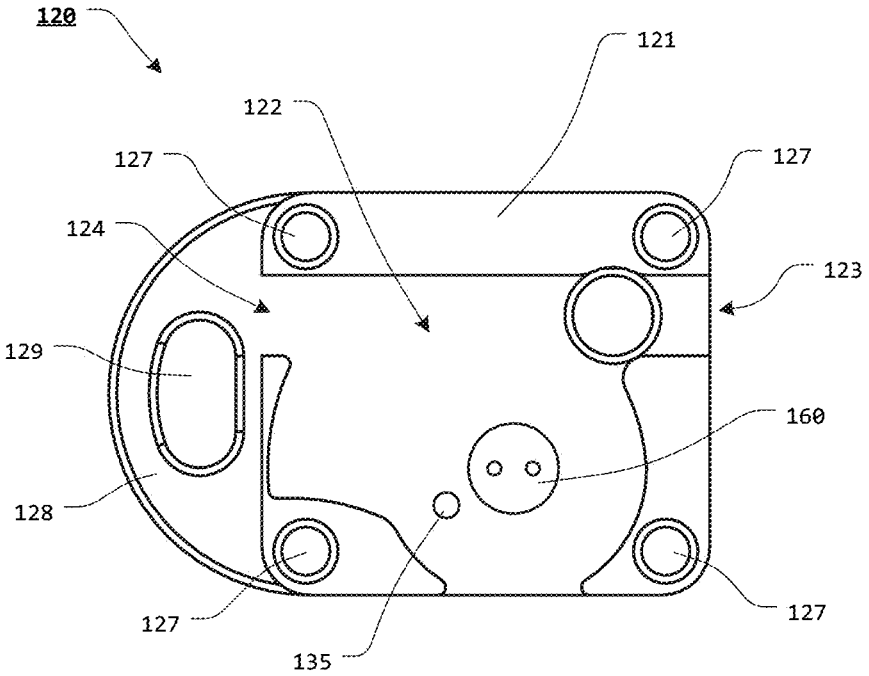
FIG. 13 illustrates a front view of an exemplary embodiment of a lace lock base, according to the present disclosure.

For simplicity and clarification, the design factors and operating principles of the lace lock according to the present disclosure are explained with reference to various exemplary embodiments of a lace lock according to the present disclosure. The basic explanation of the design factors and operating principles of the lace lock is applicable for the understanding, design, and operation of the lace lock of the present disclosure. It should be appreciated that the lace lock can be adapted to many applications where a lace lock can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed lace lock may optionally be used in a "mirror image" assembly, wherein elements shown and/or described as being included in or on a right side portion may optionally be included in or on a left side portion. Alternatively, certain of the elements that are shown and/or described as being included in or on a back portion may optionally be included in or on a front portion, or vice versa.

It should also be appreciated that the terms "lace lock" and "lace cord" are used for basic explanation and understanding of the operation of the systems, methods, and apparatuses of the present disclosure. Therefore, the terms "lace lock" and "lace cord" are not to be construed as limiting the systems, methods, and apparatuses of the present disclosure.

Furthermore, it should be appreciated that, for simplicity and clarification, the embodiments of the present disclosure will be shown and/or described with reference to the lace lock being utilized in connection with the shoestring of a boot. However, it should be appreciated that the lace lock of the present disclosure may be utilized in connection with any type of footwear that utilizes a shoestring or other cord.

Turning now to the appended drawing figures, FIGS. 1-34 illustrate certain elements and/or aspects of certain exemplary embodiments of a lace lock or lace lock assembly 100, according to the present disclosure.

As illustrated most clearly in FIGS. 1-18, the lace lock assembly 100 comprises at least some of a coupling element 110, a lace lock base 120, a torsion spring 130, a cam lock 140, an optional washer 170, a lace lock cover 150, and a fastener 160.

In various exemplary embodiments, the coupling element 110 includes a substantially planar coupling base 115 having coupling posts 117 extending from the coupling base 115. Generally, the size and shape of the coupling element 110 is dictated by the lace lock base 120, as the coupling element 110 is configured so as to allow the lace lock base 120 to be releasably attached or coupled to the coupling element 110.

As illustrated, each of four coupling posts 117 extends substantially perpendicular to a plane formed by the front surface of the coupling base 115. The size, shape, and position of each coupling post 117 is such that each coupling post 117 may be at least partially received within a corresponding post tunnel 127 of lace lock base 120. Thus, it should be appreciated that the number and placement of coupling posts 117 is a design choice and not limited by the description or illustrations of the present disclosure.

Each coupling post 117 includes a spring biased ball detent 118 or other element that allows the coupling post 117 to be further releasably secured within a corresponding post tunnel 127.

One or more base securing apertures 113 may optionally be formed within the coupling base 115, so as to allow a fastening element 165 to be positioned therethrough to attach or couple the coupling element 110 to a boot 10, shoe, or other item. Alternatively, at least a portion of a rear surface of the coupling base 115 may be at least partially covered by a mating portion of a releasable fastener element (not illustrated), so as to be attached or coupled to a mating portion of a releasable fastener element attached or coupled to a boot 10, shoe, or other item. In various exemplary embodiments, the releasable fastener element may optionally comprise a portion of hook and loop fastener, such as Velcro. It should be appreciated that, in various exemplary embodiments the releasable fastener element may comprise a mating portion of another releasable coupler or releasable fastener, such as, for example, a portion or mating element of a hook-and-pile fastener or touch fastener, buttons, snaps, or other fastening, closure, or other releasably mating attachment device known to those skilled in the art.

The lace lock base 120 comprises a base body 121. In various exemplary embodiments, at least and outer perimeter of the base body 121 is sized and shaped so as to at least partially correspond to the outer perimeter of the coupling element 110. The base body 121 includes a plurality of post tunnels 127, each formed so as to correspond to a coupling post 117 of the coupling element 110. Each post tunnel 127 is formed through a portion of the base body 121 so as to allow at least a portion of a coupling post 117 to be removably received therein. In various exemplary embodiments, an inner diameter of a surface of each post tunnel 127 is formed so as to provide frictional engagement between an outer surface of each coupling post 117.

Each post tunnel 127 may optionally include a recessed portion (not illustrated), which allows for additional engagement between a ball detent 118 of a coupling post 117 and the recessed portion.

Thus, the base body 121 can be removably attached or coupled to the coupling element 110, via interaction of one or more corresponding coupling posts 117 and post tunnels 127. In a non-deployed configuration, the coupling element 110 is attached or coupled to, for example, a boot 10 and the lace lock base 120 is removably attached or coupled to the coupling element 110. When the lace lock assembly 100 is in a deployed configuration, the lace lock base 120 is removed from the coupling element 110.

While the coupling element 110 is illustrated as being removably attached or coupled to the lace lock base 120 via interaction of one or more coupling posts 117 and post tunnels 127, it should be appreciated that the coupling element 110 may be removably or releasably attached or coupled to the lace lock base 120 via other means, such as, for example, a slidably releasable extensions and recesses, magnets, or other known or similar mating elements.

As illustrated, a base cavity 122 is formed within at least a portion of the base body 121. The base cavity 122 is formed so as to allow the cam lock 140 to be pivotably positioned within the base cavity 122. A base cam post 125 extends within the base cavity 122. The base cam post 125 is formed so as to be positioned within a cam lock aperture 142 of the cam lock 140, such that the cam lock 140 is rotatable or pivotable within the base cavity 122, about the base cam post 125.

A cam post recess 126 is formed in the base cam post 125, which allows a fastener 160 to be positioned at least partially within the cam post recess 126. In various exemplary embodiments, the cam post recess 126 is internally threaded so as to interact with external threads of the fastener 160.

A base entry slot 123 is formed so as to allow access from an exterior of the base body 121 to the base cavity 122. Similarly, a base exit slot 124 is formed so as to allow access from an exterior of the base body 121 to the base cavity 122.

Figure 16:
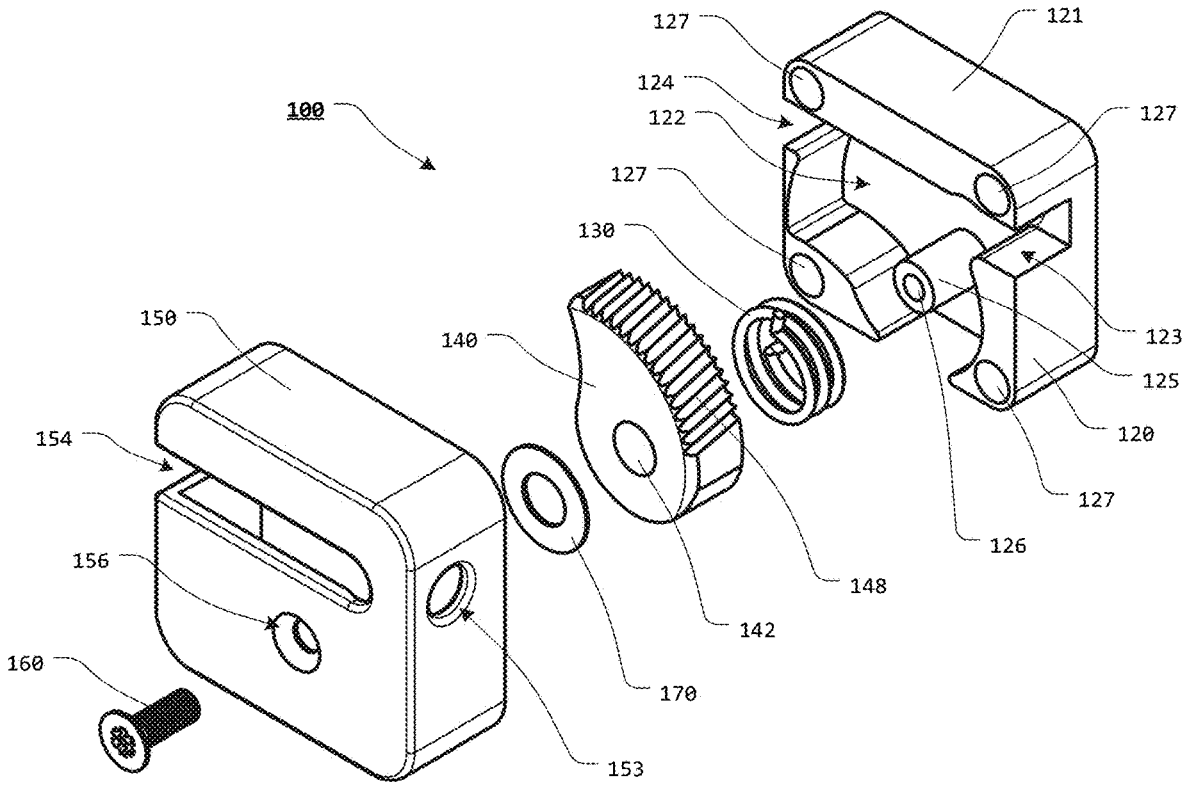
FIG. 16 illustrates an exploded view of certain exemplary components of an exemplary embodiment of a lace lock assembly, according to the present disclosure.
Figure 17:
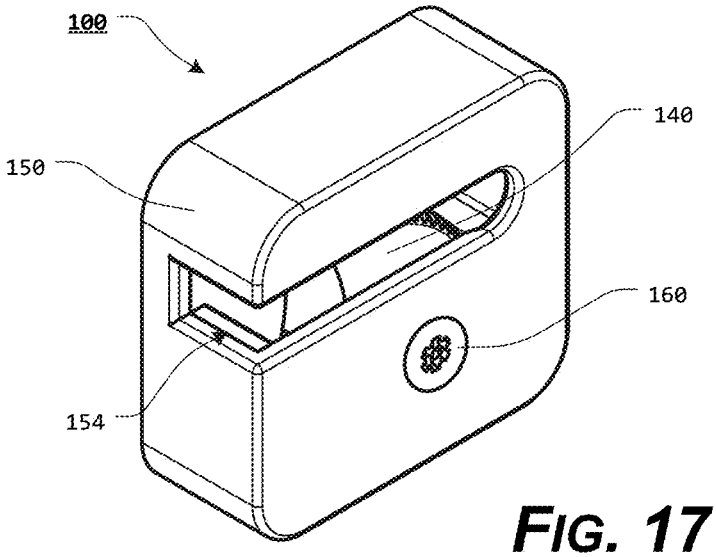
FIG. 17 illustrates a front, side perspective view of certain exemplary components of an exemplary embodiment of a lace lock assembly, according to the present disclosure.
Figure 18:
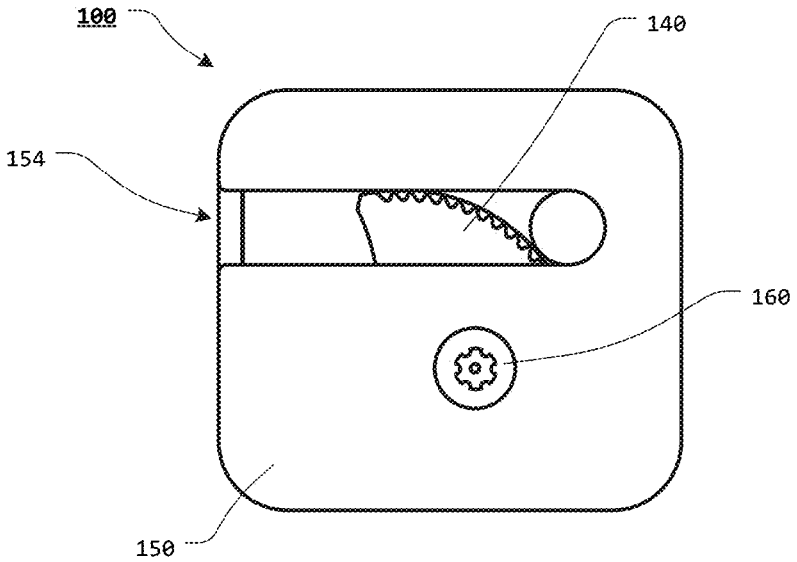
FIG. 18 illustrates a front view of certain exemplary components of an exemplary embodiment of a lace lock assembly, according to the present disclosure.
Figure 19:
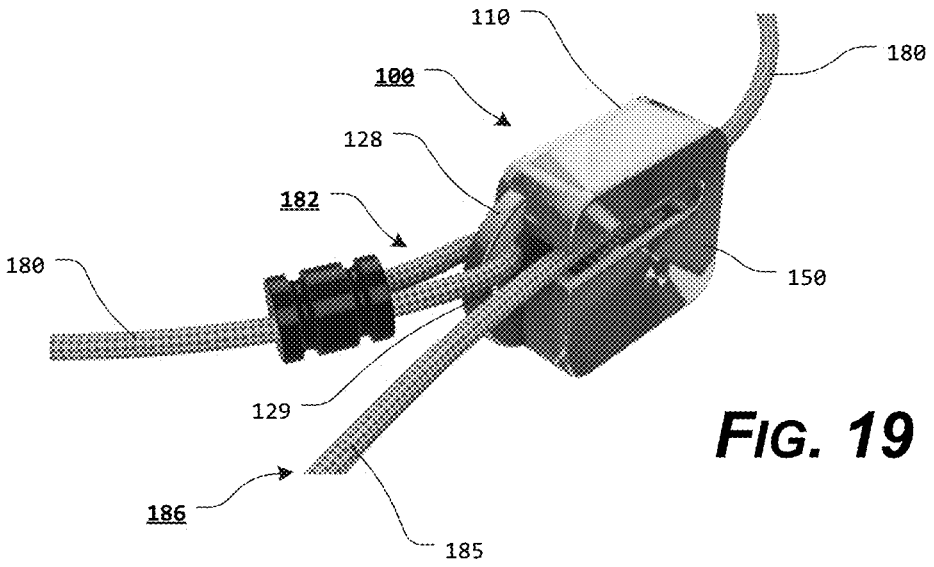
FIG. 19 illustrates a more detailed, perspective view of certain exemplary components of an exemplary embodiment of a lace lock assembly and lace cord, according to the present disclosure.
Figure 20:
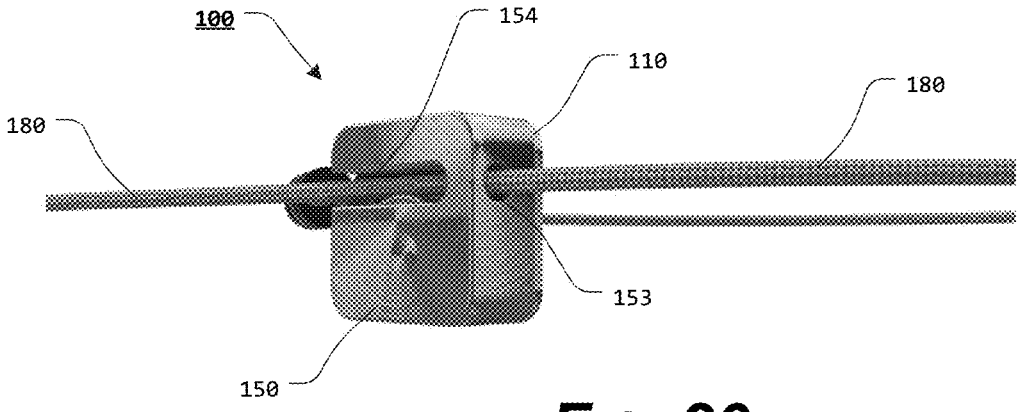
FIG. 20 illustrates a more detailed, perspective view of certain exemplary components of an exemplary embodiment of a lace lock assembly and lace cord, according to the present disclosure.
Figure 21:
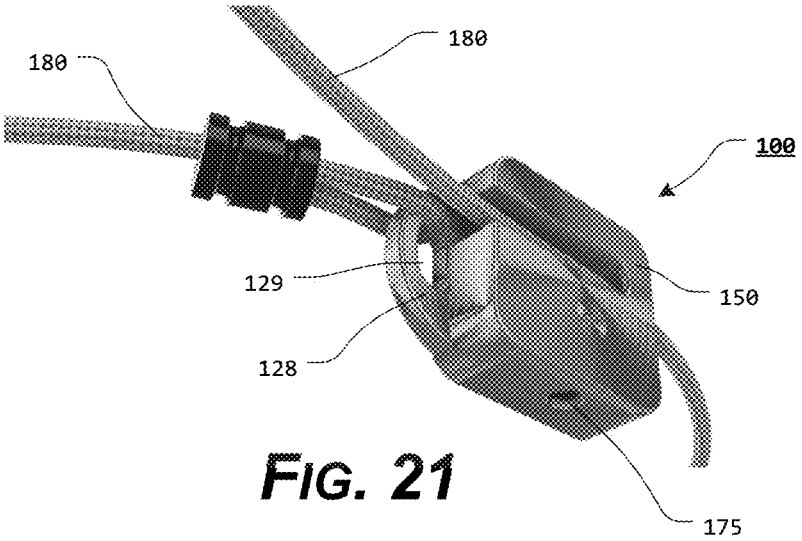
FIG. 21 illustrates a more detailed, perspective view of certain exemplary components of an exemplary embodiment of a lace lock assembly and lace cord, according to the present disclosure.
Figure 22:
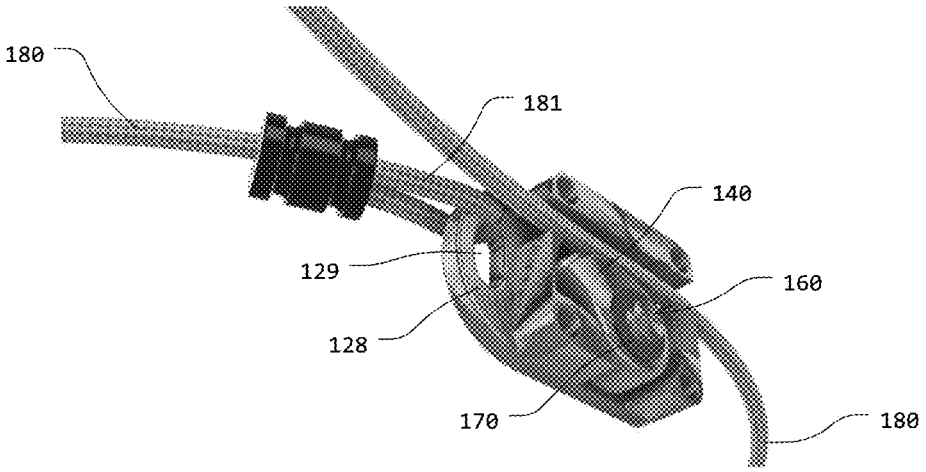
FIG. 22 illustrates a more detailed, perspective view of certain exemplary components of an exemplary embodiment of a lace lock assembly and lace cord, according to the present disclosure.
Figure 23:
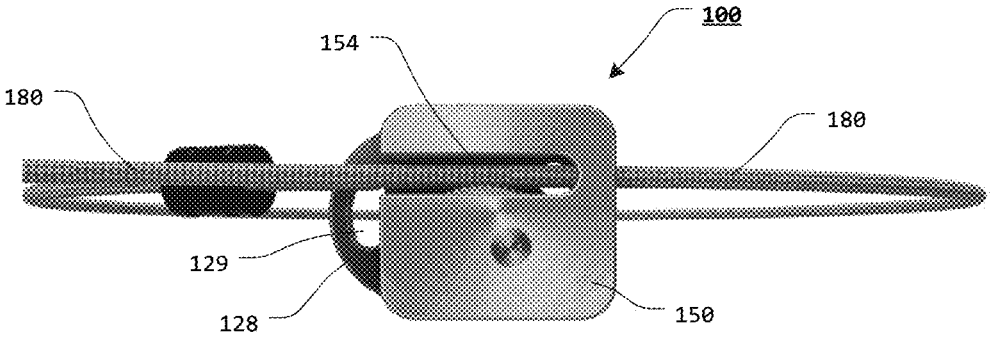
FIG. 23 illustrates a more detailed, perspective view of certain exemplary components of an exemplary embodiment of a lace lock assembly and lace cord, according to the present disclosure.
Figure 24:
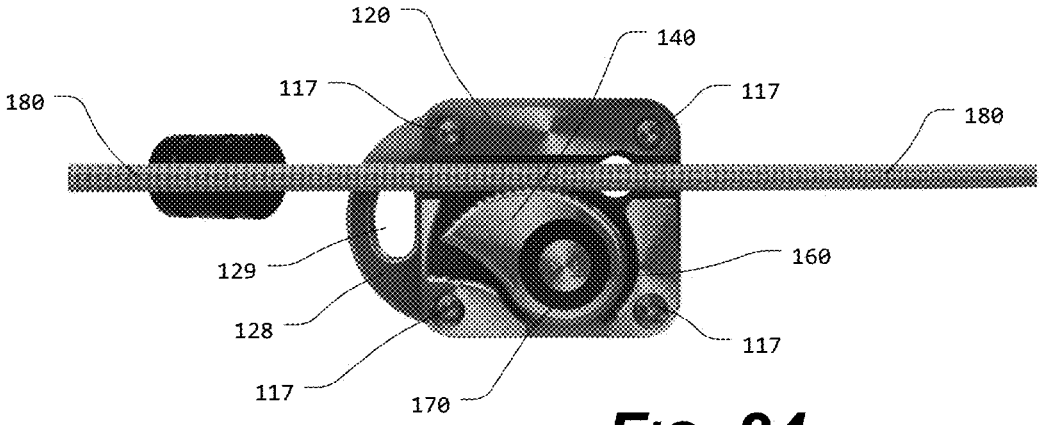
FIG. 24 illustrates a more detailed, perspective view of certain exemplary components of an exemplary embodiment of a lace lock assembly and lace cord, according to the present disclosure.
Figure 25:
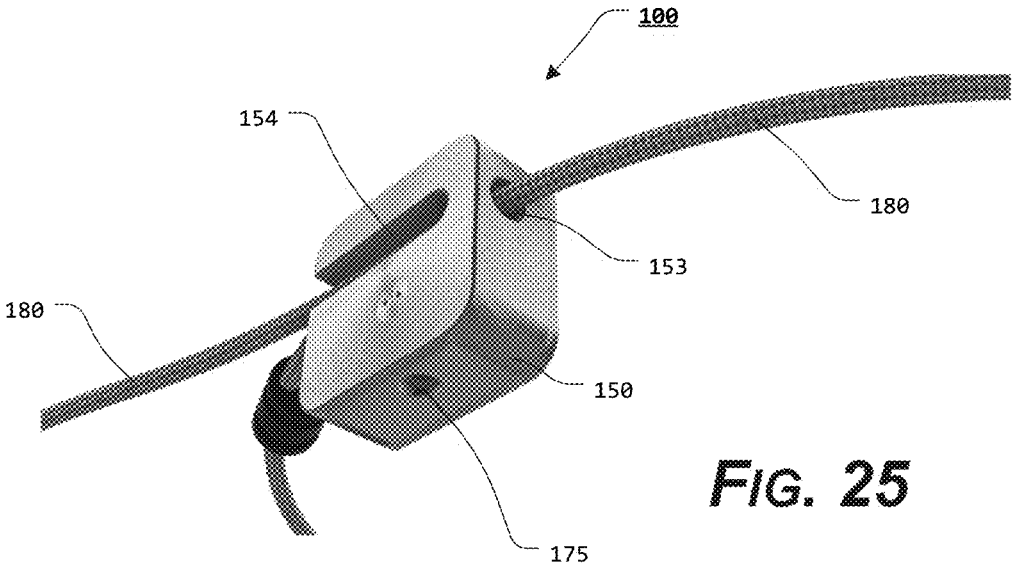
FIG. 25 illustrates a more detailed, perspective view of certain exemplary components of an exemplary embodiment of a lace lock assembly and lace cord, according to the present disclosure.
Figure 26:
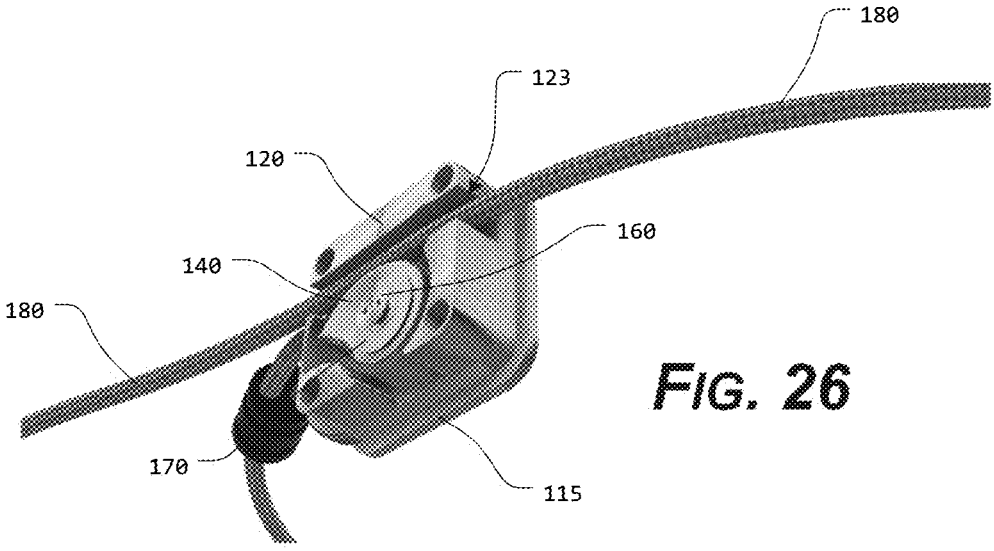
FIG. 26 illustrates a more detailed, perspective view of certain exemplary components of an exemplary embodiment of a lace lock assembly and lace cord, according to the present disclosure.
Figure 27:
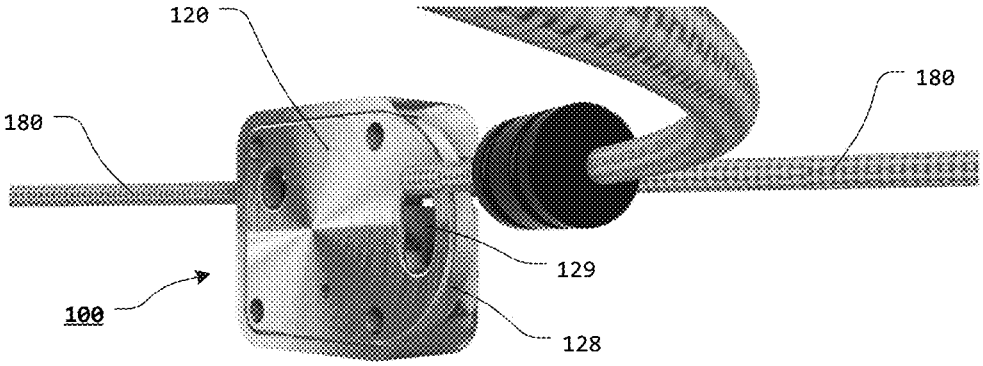
FIG. 27 illustrates a more detailed, perspective view of certain exemplary components of an exemplary embodiment of a lace lock assembly and lace cord, according to the present disclosure.
Figure 28:
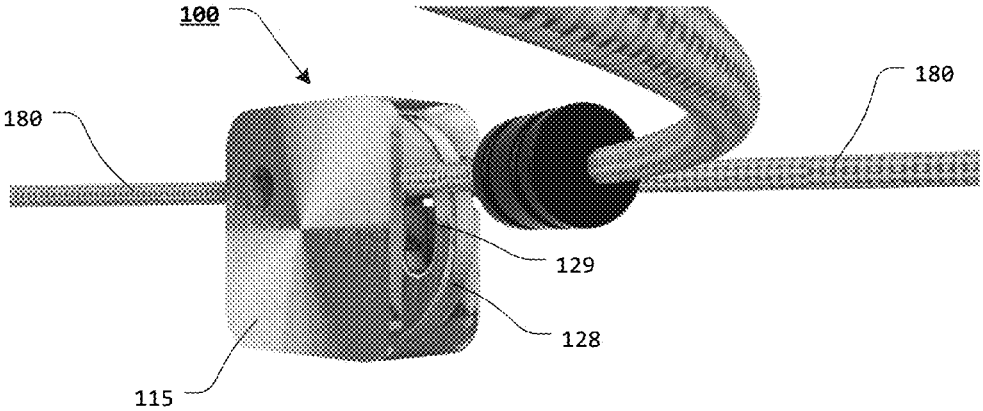
FIG. 28 illustrates a more detailed, perspective view of certain exemplary components of an exemplary embodiment of a lace lock assembly and lace cord, according to the present disclosure.

In various exemplary embodiments, an anchor loop 128 optionally extends from a portion of the base body 121. The anchor loop 128 includes an anchor loop aperture 129 formed through the anchor loop 128. It should be appreciated that the anchor loop 128 is optional and the lace lock base 120 may be formed without the anchor loop 128, as illustrated in FIGS. 16-18.

A base cavity anchor 135 is formed through a portion of the base body 121, within the base cavity 122, proximate the base cam post 125. The base cavity anchor 135 is formed so as to interact with a torsion spring anchor 132 of the torsion spring 130 when the torsion spring 130 is positioned about the base cam post 125. In this manner, action between the base cavity anchor 135 and the torsion spring anchor 132 maintain the torsion spring 130 in a substantially fixed rotational position relative to the lace lock base 120.

In various exemplary buttons, the torsion spring 130 comprises a coiled portion of spring material having torsion spring anchors 132 formed at each end of the torsion spring 130. The torsion spring anchors 132 each extend from the torsion spring 130 so as to be at least partially received within an anchor (either base cavity anchor 135 or spring recess anchor 146) to allow rotational tension to be provided to the torsion spring 130.

The cam lock 140 comprises a cammed or arced portion forming a camming surface 141. In various exemplary embodiments, at least a portion of the camming surface 141 includes a textured portion 148. The textured portion 148 allows a portion of the camming surface 141 to have increased frictional engagement with a shoelace, shoestring, or lace cord 180. In certain exemplary embodiments, the textured portion 148 comprises a series of substantially parallel grooves formed in an exterior surface of the camming surface 141. The textured portion 148 may be formed so as to be directional, allowing the lace cord 180 to slide comparatively smoothly relative to the textured portion 148, when moving in one direction, but be frictionally engaged by the textured portion 148, when urged in the opposite direction. Thus, the lace cord 180 can more easily pass along the textured portion 148 when urged in an insertion direction, but frictionally engage the textured portion 148 when urged in a withdrawing direction. As illustrated herein, the textured portion 148 may optionally be formed along a single surface of the cam lock 140.

A cam lock aperture 142 is formed through the cam lock 140. The inner diameter of the cam lock aperture 142 substantially corresponds to the outer diameter of the base cam post 125, such that at least a portion of the base cam post 125 can be positioned within the cam lock aperture 142, allowing the cam lock 140 to pivot or rotate about the base cam post 125.

A torsion spring recess 145 is formed within a portion of the cam lock 140, extending from the cam lock 140. The torsion spring recess 145 is formed so as to surround at least a portion of the cam lock aperture 142 and allow the torsion spring 130 to be received therein. In various exemplary embodiments, a spring recess anchor 146 extends from a portion of the torsion spring recess 145. The spring recess anchor 146 is formed so as to allow at least a portion of a torsion spring anchor 132 to be received therein, such that action between the spring recess anchor 146 and the torsion spring anchor 132 maintain the torsion spring 130 in a substantially fixed rotational position relative to the cam lock 140.

The lace lock cover 150 is formed so as to be a cover for at least a portion of the lace lock base 120. The lace lock cover 150 includes a cover body 151 having a cover cavity 152 formed therein. The cover cavity 152 is formed so as to receive at least a portion of the base body 121 of the lace lock base 120 therein.

A fastener aperture 156 is formed through a portion of the cover body 151, typically through a front wall of the cover body 151. When the base body 121 is appropriately positioned within the cover cavity 152, the fastener aperture 156 is aligned with the cam post recess 126, to allow a fastener 160 to be positioned through the fastener aperture 156 and interact with the cam post recess 126.

A cover entry aperture 153 is formed through a portion of the cover body 151, typically through a sidewall of cover body 151. When the base body 121 is appropriately positioned within the cover cavity 152, the cover entry aperture 153 is aligned with the base entry slot 123 of the base body 121.

A cover exit slot 154 is formed through a portion of the cover body 151, typically through a portion of the front wall of the cover body 151 and a sidewall of the cover body 151, substantially opposite the cover entry aperture 153. When the base body 121 is appropriately positioned within the cover cavity 152, the cover exit slot 154 is aligned with the base exit slot 124 and optionally a portion of the base cavity 122.

In various exemplary embodiments, various components of the lace lock assembly 100 are substantially rigid and are formed of plastic. Alternate materials of construction of the various components of the lace lock assembly 100 may include one or more of the following: steel, titanium, aluminum, stainless steel, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the lace lock assembly 100 is a design choice based on the desired appearance and functionality of the lace lock assembly 100.

It should be appreciated that certain elements of the lace lock assembly 100 may be formed as an integral unit. Alternatively, suitable materials can be used and sections or elements made independently and attached or coupled together, such as by adhesives, welding, screws, rivets, pins, or other fasteners, to form the various elements of the lace lock assembly 100.

It should also be understood that the overall size and shape of the lace lock assembly 100 and the various portions thereof is a design choice based upon the desired functionality and/or appearance of the lace lock assembly 100.

The lace lock assembly 100 is operable in connection with shoestrings, shoelaces, lace cords 180, or the like. It should be appreciated that the term lace cord 180, as used herein is merely illustrative and not limiting as to the types of shoestrings, shoelaces, or cords that are operable with the lace lock assembly 100. Furthermore, it should also be appreciated that the term cord is to be given its broadest meaning and that the particular fabric(s) or material(s) used to form the cord or lace cord 180 is a design choice based on the desired appearance, strength, width, and/or functionality of the lace cord 180.

During assembly of the lace lock assembly 100, the torsion spring 130 is positioned around the base cam post 125, such that one of the torsion spring anchors 132 is positioned at least partially within the base cavity anchor 135. The cam lock aperture 142 of the cam lock 140 is aligned with the base cam post 125 and urged, along the base cam post 125, into the base cavity 122. As the cam lock 140 is positioned within the base cavity 122, the torsion spring 130 is positioned within the torsion spring recess 145 of the cam lock 140 and the other of the torsion spring anchors 132 is positioned at least partially within the spring recess anchor 146 of the torsion spring recess 145.

Figure 14:
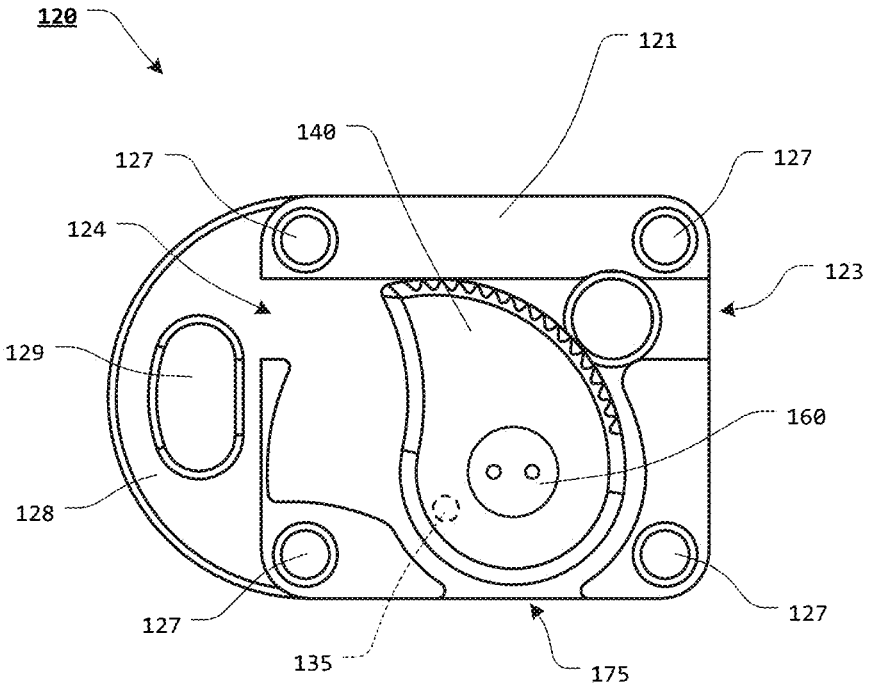
FIG. 14 illustrates a front view of an exemplary embodiment of a lace lock base and cam lock, wherein the cam lock is in an engaged position, according to the present disclosure.
Figure 15:
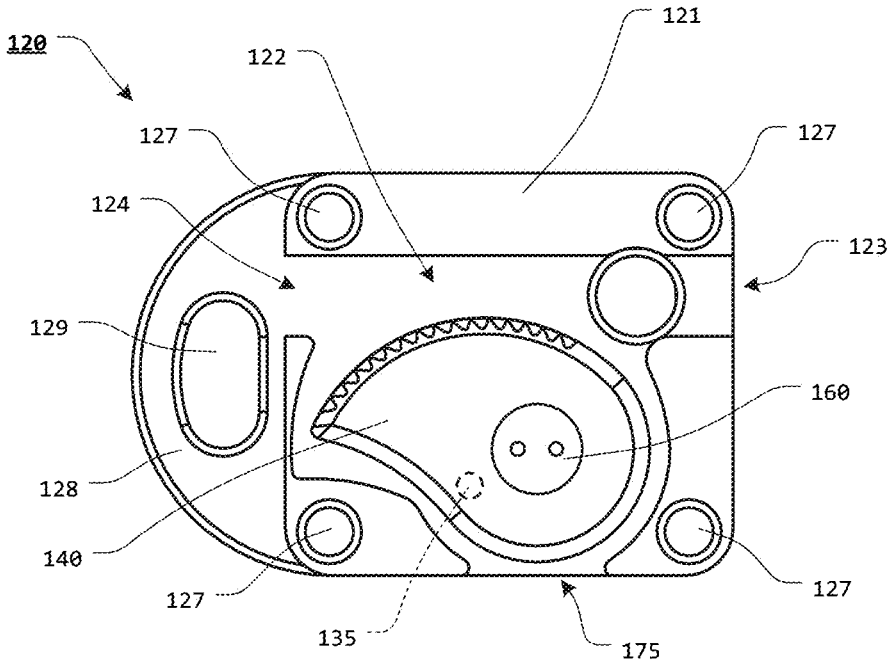
FIG. 15 illustrates a front view of an exemplary embodiment of a lace lock base and cam lock, wherein the cam lock is in a disengaged position, according to the present disclosure.

By securing the torsion spring 130 within the torsion spring recess 145 of the cam lock 140 and anchoring the torsion spring anchors 132 relative to the cam lock 140 and the lace lock base 120, the cam lock 140 is spring biased to an engaged position, as illustrated, for example, in FIG. 14. As the spring biased of the torsion spring 130 is overcome, the cam lock 140 can be rotated to a disengaged or released position, as illustrated, for example in FIG. 15.

The lace lock cover 150 is then positioned relative to the lace lock base 120 such that at least a portion of the base body 121 is positioned within the cover cavity 152, the fastener aperture 156 is aligned with the cam post recess 126, the cover entry aperture 153 is aligned with at least a portion of the base entry slot 123, and the cover exit slot 154 is aligned with at least a portion of the base exit slot 124.

In various exemplary, nonlimiting embodiments, a drainage aperture 175 is formed through one or more portions of the base body 121 and the lace lock cover 150 to allow fluid to flow from the base cavity 122, through the lace lock cover 150, to be expelled from the lace lock assembly 100.

Once appropriately positioned, a fastener 160 positioned through the fastener aperture 156 interacts with the cam post recess 126 to secure the lace lock cover 150 to the lace lock base 120. Additionally, the interaction of the fastener 160 and lace lock cover 150 with the secure the cam lock 140 within the base cavity 122.

In certain exemplary embodiments, a washer 170 is optionally provided between the cam lock 140 and an interior surface of the cover cavity 152. The washer 170, if provided, may provide for reduced frictional engagement between the surface of the cam lock 140 at a surface of the cover cavity 152.

In various exemplary embodiments, as illustrated, for example, in FIGS. 19-28, a terminating distal end portion 181 of the lace cord 180 is attached or coupled to the anchor loop 128, by the anchor loop aperture 129, forming an anchored end portion 182.

Once assembled, a terminating proximal end portion 185 of the lace cord 180, forming a free end portion 186, may be urged through the aligned cover entry aperture 153 and base entry slot 123, and into the base cavity 122. The free end portion 186 of the lace cord 180 then engages the camming surface 141 of the cam lock 140 and, as a sufficient insertion force is applied to the lace cord 180, urges the cam lock 140 towards the disengaged position. When urged toward the disengaged position, the camming surface 141 is cammed away from an inner wall of the base cavity 122 and allows the lace cord 180 to be urged toward and through the aligned base exit slot 124 and cover exit slot 154. When the free end portion 186 of the lace cord 180 is urged through the aligned base exit slot 124 and cover exit slot 154, the free end portion 186 of the lace cord 180 can be pulled away from the lace lock base 120.

Figure 29:
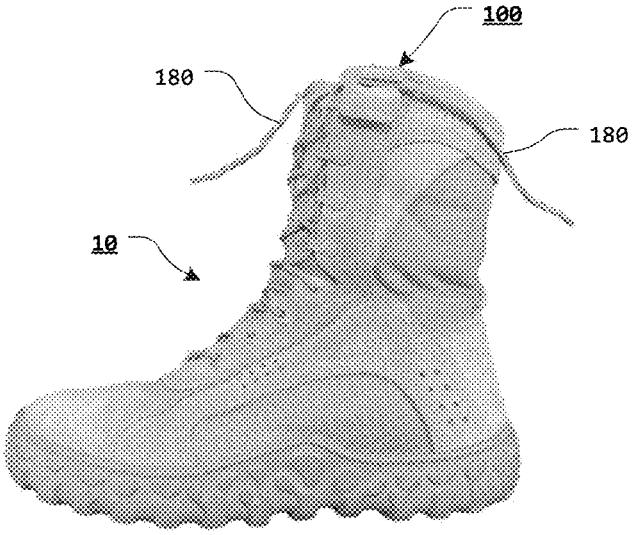
FIG. 29 illustrates an exemplary embodiment of a lace lock assembly and lace cord utilized with an exemplary boot, according to the present disclosure.
Figure 30:
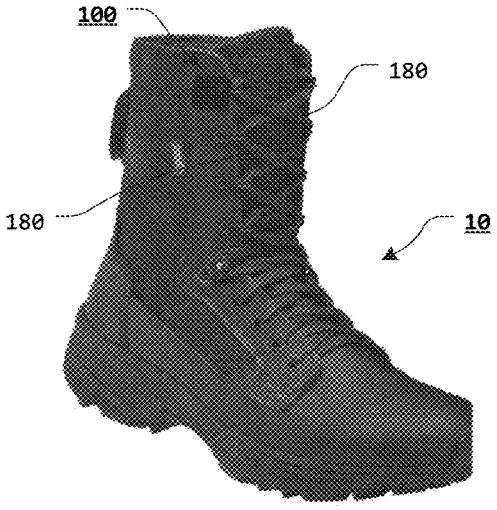
FIG. 30 illustrates an exemplary embodiment of a lace lock assembly and lace cord utilized with an exemplary boot, according to the present disclosure.
Figure 31:
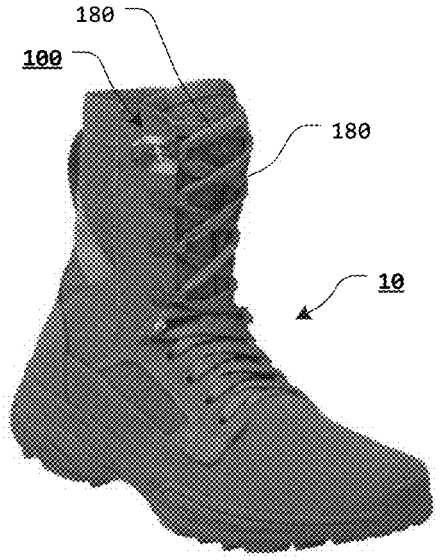
FIG. 31 illustrates an exemplary embodiment of a lace lock assembly and lace cord utilized with an exemplary boot, according to the present disclosure.

When the lace lock base 120 of the lace lock assembly 100 is releasably attached or coupled to the coupling element 110 (the coupling element 110 being attached or coupled to a boot 10, shoe, or other type of footwear), as illustrated, for example, in FIGS. 29-31, the lace lock assembly 100 can be used to tighten or loosen the lace cord 180, utilized as a shoelace or shoestring.

To tighten the lace cord 180, the free end portion 186 of the lace cord 180 is pulled relative to the lace lock base 120, such that the lace cord 180 is pulled along or parallel to the camming surface 141 of the cam lock 140. The spring bias of the cam lock 140 and the interaction between the textured portion 148 and the lace cord 180 allows the free end portion 186 of the lace cord 180 to be further withdrawn from the lace lock base 120. However, the spring bias of the cam lock 140 in the interaction between the textured portion 148 and the lace cord 180 resists movement of the lace cord 180 in a withdrawing direction, i.e., toward the base entry slot 123 and the cover entry aperture 153).

To loosen the lace cord 180, the portion of lace cord 180 extending from the cover exit slot 154 is pulled along the cover exit slot 154, toward the cover entry aperture 153. As the lace cord 180 is pulled along the cover exit slot 154, toward the cover entry aperture 153, the lace cord 180 is pulled substantially perpendicular to the camming surface 141 of the cam lock 140 and withdrawn from the camming surface 141 of the cam lock 140. When the lace cord 180 is fully withdrawn from the camming surface 141 of the cam lock 140 and an adjacent inner surface of the base cavity 122, the lace cord 180 can be withdrawn from the base cavity 122 and the lace lock base 120.

Thus, when not in use as tourniquet, the lace lock assembly 100 can be utilized to tighten or loosen the lace cord 180, so that the lace cord 180 can either be tied, in a traditional manner, or held in a tighten position by the lace lock assembly 100.

Figure 32:
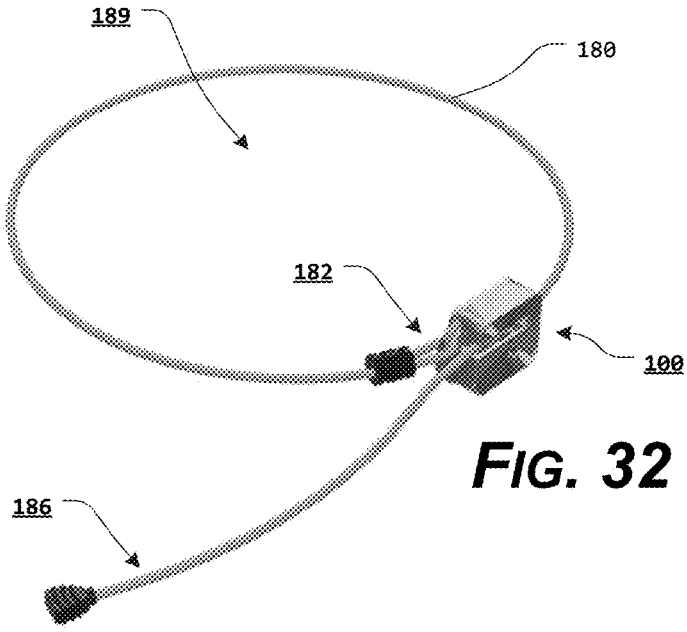
FIG. 32 illustrates an exemplary embodiment of a lace lock assembly and lace cord configured to be utilized as a tourniquet, according to the present disclosure.
Figure 33:
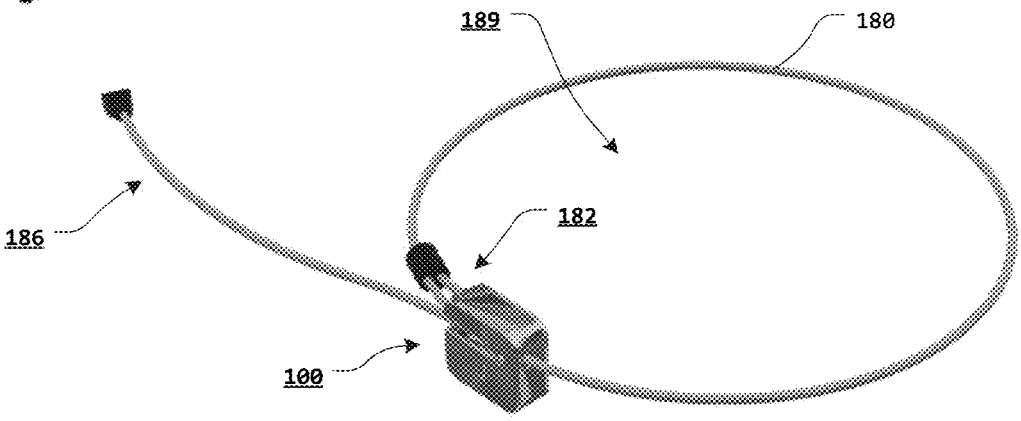
FIG. 33 illustrates an exemplary embodiment of a lace lock assembly and lace cord configured to be utilized as a tourniquet, according to the present disclosure.
Figure 34:
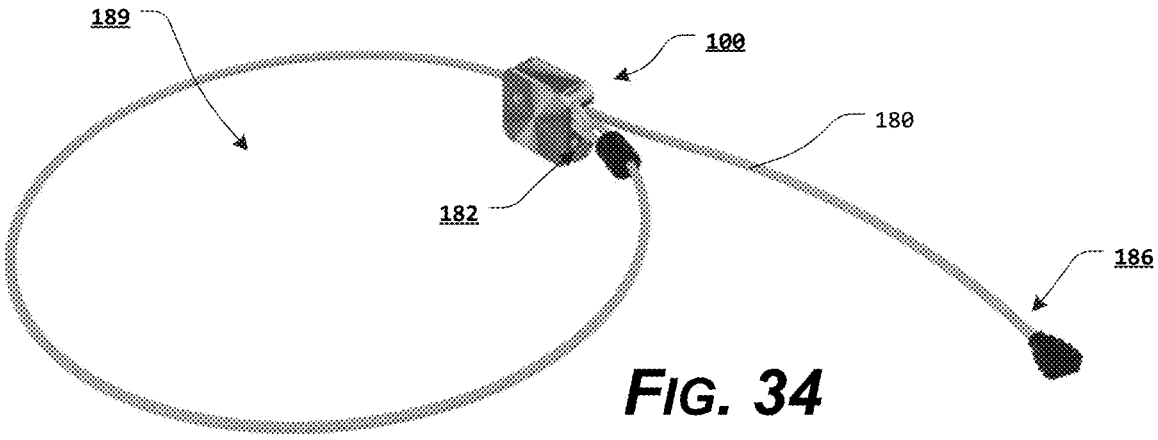
FIG. 34 illustrates an exemplary embodiment of a lace lock assembly and lace cord configured to be utilized as a tourniquet, according to the present disclosure.
Figure 35:
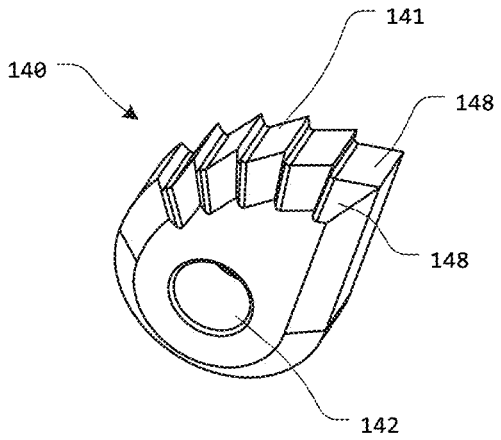
FIG. 35 illustrates a front perspective view of an exemplary embodiment of a cam lock of a lace lock assembly, according to the present disclosure.
Figure 36:
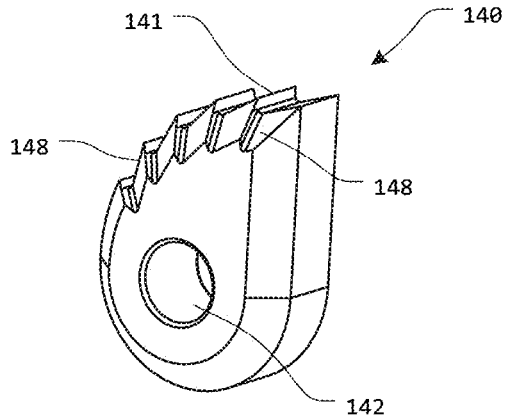
FIG. 36 illustrates a front perspective view of an exemplary embodiment of a cam lock of a lace lock assembly, according to the present disclosure.
Figure 37:
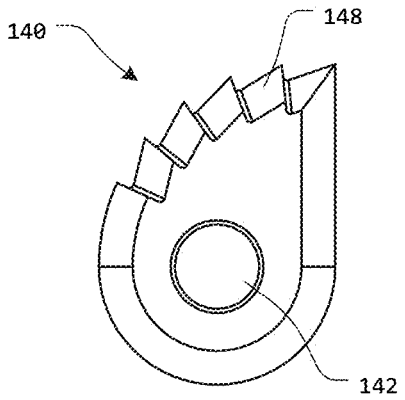
FIG. 37 illustrates a front view of an exemplary embodiment of a cam lock of a lace lock assembly, according to the present disclosure.
Figure 38:
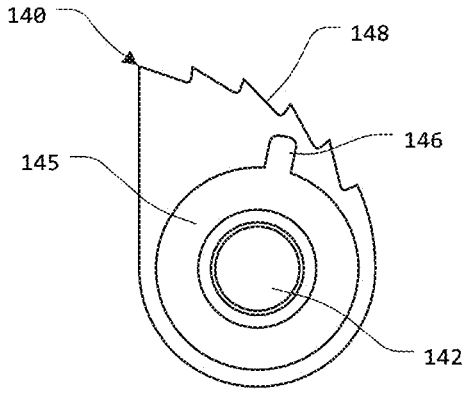
FIG. 38 illustrates a rear view of an exemplary embodiment of a cam lock of a lace lock assembly, according to the present disclosure.
Figure 39:
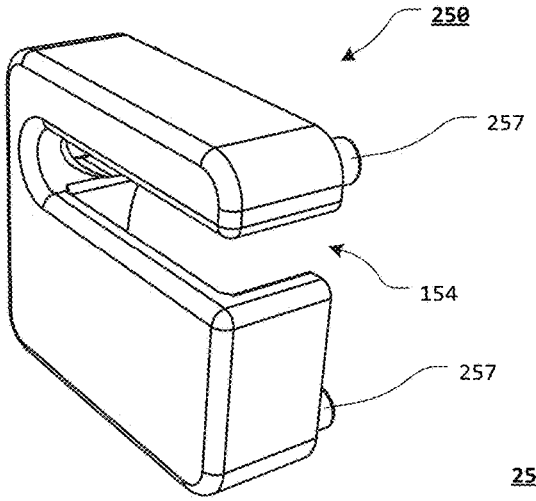
FIG. 39 illustrates a front perspective view of an exemplary embodiment of a lace lock cover of a lace lock assembly, according to the present disclosure.
Figure 40:
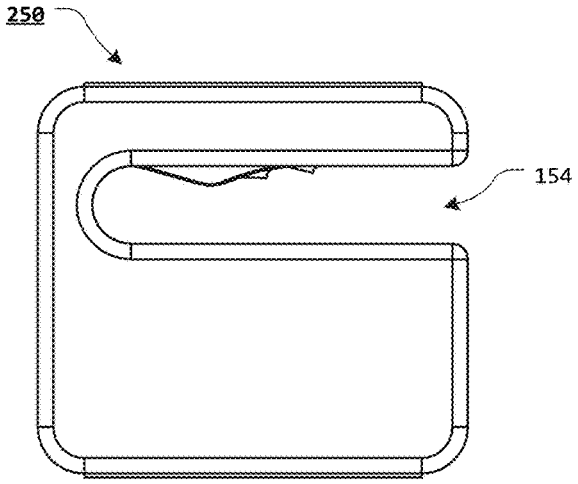
FIG. 40 illustrates a front view of an exemplary embodiment of a lace lock cover of a lace lock assembly, according to the present disclosure.
Figure 41:
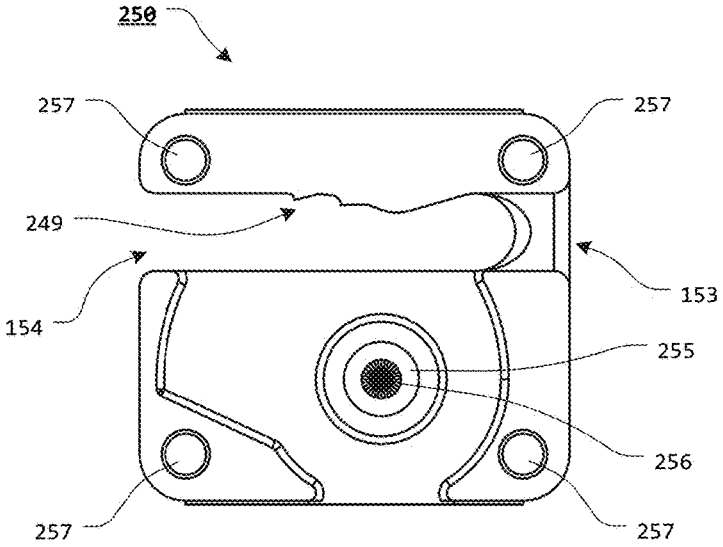
FIG. 41 illustrates a rear view of an exemplary embodiment of a lace lock cover of a lace lock assembly, according to the present disclosure.
Figure 42:
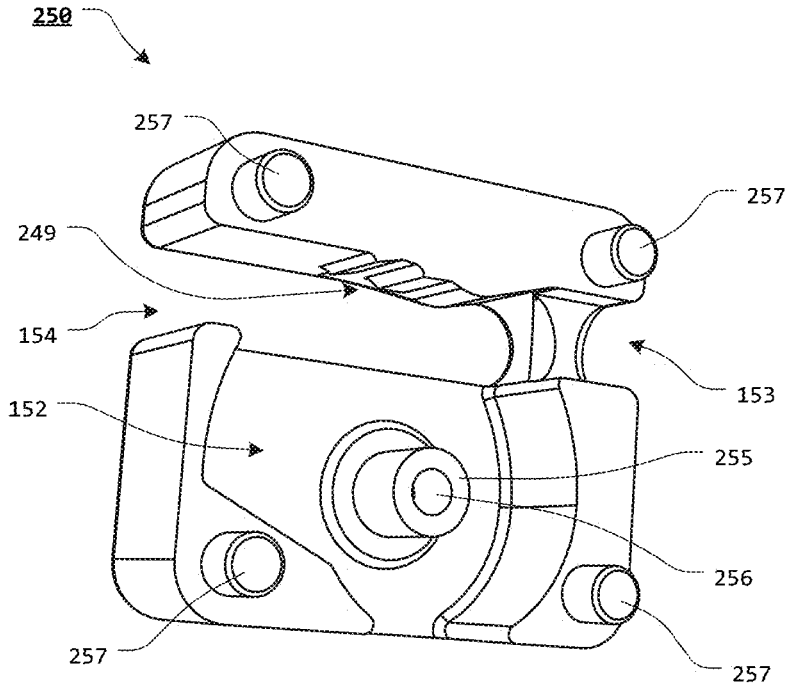
FIG. 42 illustrates a rear perspective view of an exemplary embodiment of a lace lock cover of a lace lock assembly, according to the present disclosure.
Figure 43:
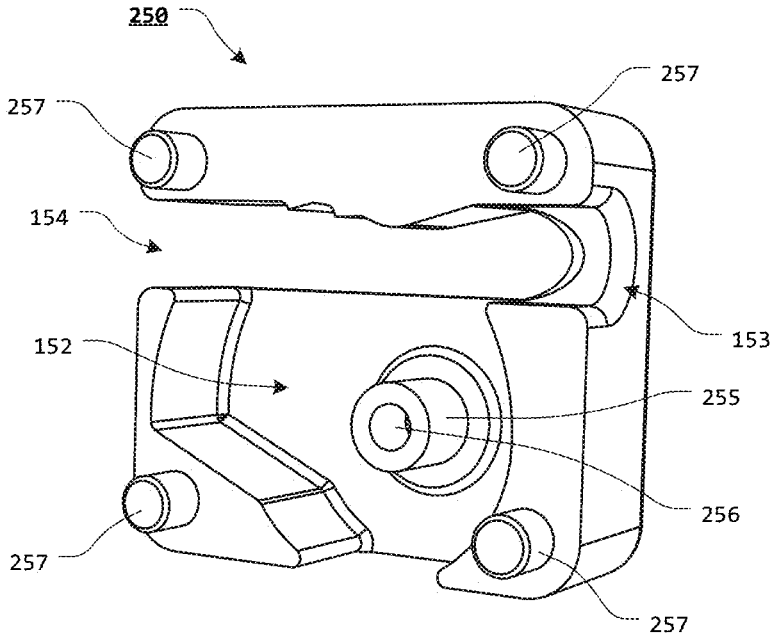
FIG. 43 illustrates a rear perspective view of an exemplary embodiment of a lace lock cover of a lace lock assembly, according to the present disclosure.
Figure 44:
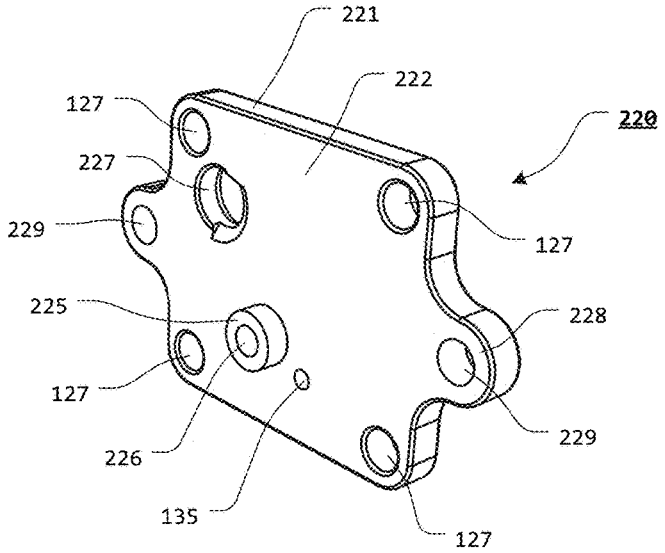
FIG. 44 illustrates a front perspective view of an exemplary embodiment of a base body of a lace lock assembly, according to the present disclosure.
Figure 45:
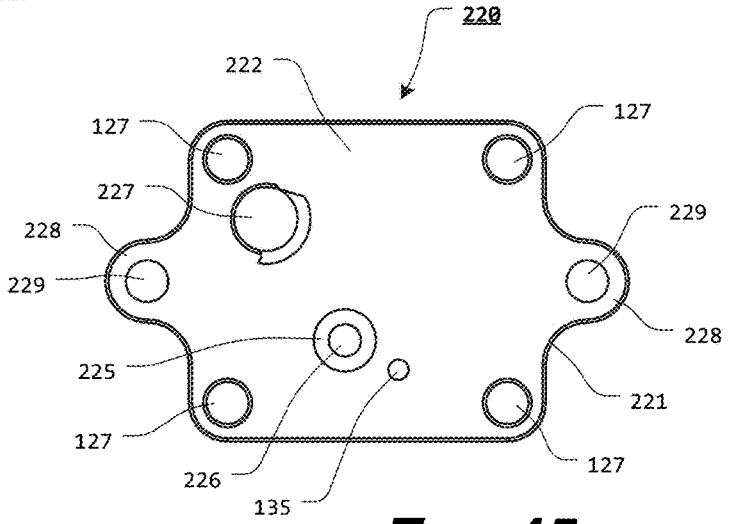
FIG. 45 illustrates a front view of an exemplary embodiment of a base body of a lace lock assembly, according to the present disclosure.
Figure 46:
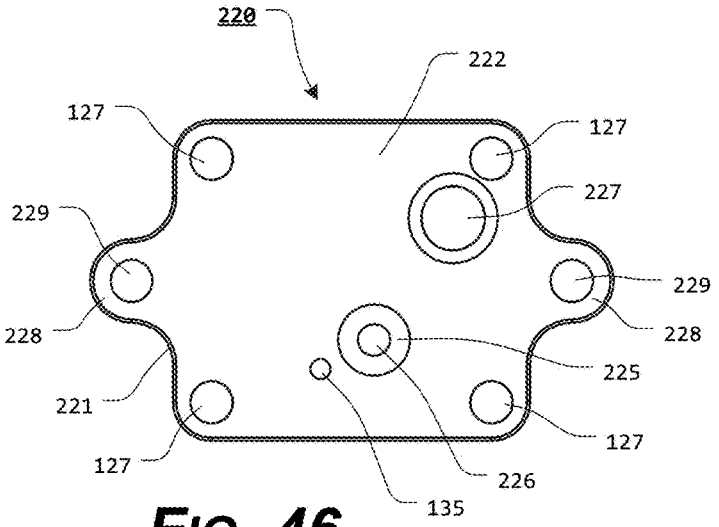
FIG. 46 illustrates a rear view of an exemplary embodiment of a base body of a lace lock assembly, according to the present disclosure.
Figure 47:
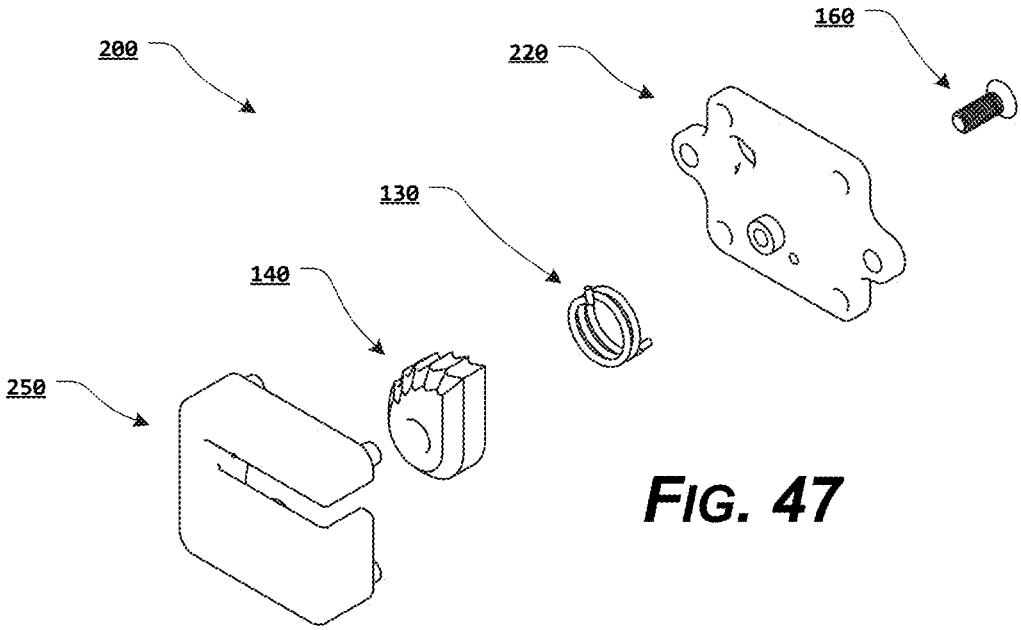
FIG. 47 illustrates an exploded front perspective view of certain exemplary components of an exemplary embodiment of a lace lock assembly, according to the present disclosure.
Figure 48:
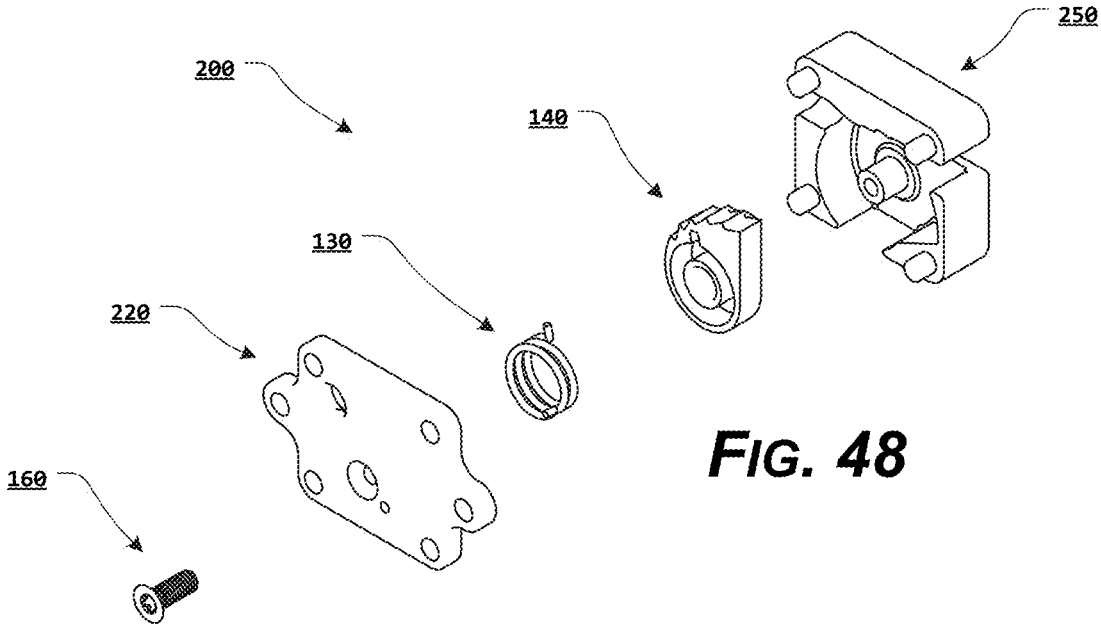
FIG. 48 illustrates an exploded rear perspective view of certain exemplary components of an exemplary embodiment of a lace lock assembly, according to the present disclosure.
Figure 49:
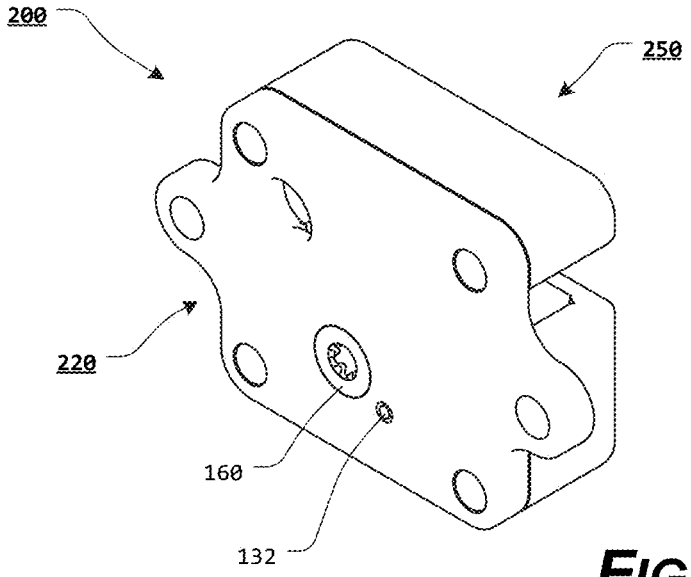
FIG. 49 illustrates a rear perspective view of an exemplary embodiment of a lace lock assembly, according to the present disclosure.
Figure 50:
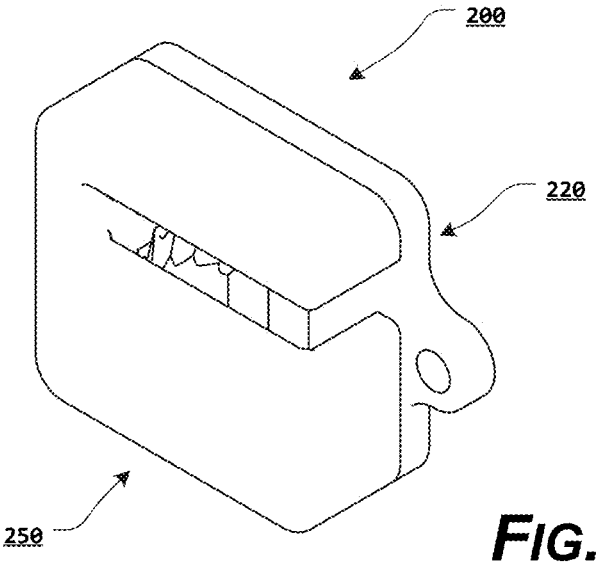
FIG. 50 illustrates a front perspective view of an exemplary embodiment of a lace lock assembly, according to the present disclosure.

To utilize the lace lock assembly 100 is a tourniquet, as illustrated, for example, in FIGS. 32-34, the lace lock base 120 is removed from the coupling element 110 and the lace cord 180 is withdrawn from the boot 10 or item of footwear.

With the free end portion 186 extending from the lace lock assembly 100, the lace cord 180 forms a tourniquet loop 189 between the lace lock assembly 100 and the anchored end portion 182. The tourniquet loop 189 can then be positioned around an extremity, as with a typical tourniquet, and the free end portion 186 can be pulled for urged away from the lace lock assembly 100, reducing the diameter of the tourniquet loop 189. Engagement between the lace cord 180 and the cam lock 140 and inner surface of the base cavity 122 allows the lace cord 180 to be frictionally maintained in a desired position relative to the lace lock base 120, even when a withdrawing force is removed from the free end portion 186 of the lace cord 180.

Thus, when an appropriate tourniquet force is applied by the tourniquet loop 189, a user can release the free end portion 186 and the tourniquet force will be maintained.

When it is desired to remove the tourniquet loop 189, the free end portion 186 of the lace cord 180 can be urged through the cover exit slot 154, toward the cover entry aperture 153, withdrawing the lace cord 180 from the position of engagement between the cam lock 140 and the inner surface of the base cavity 122, thereby allowing the free and portion of the lace cord 180 to be drawn toward the lace lock assembly 100 and expanding the radius of the tourniquet loop 189.

A more detailed explanation of the instructions regarding how to utilize the lace lock assembly 100 as a tourniquet is not provided herein because it is believed that the level of description provided herein is sufficient to enable one of ordinary skill in the art to understand and practice the systems, methods, and apparatuses, as described.

As illustrated, for example, in FIGS. 35-38, 47-48, and 57-60, the textured portion 148 may optionally be formed along a multiple surfaces or areas of the cam lock 140. Additionally, at least a portion of the cover exit slot 154 may also include a textured portion 249.

The textured portion 249, if included, allows a portion of the at least one surface of the cover exit slot 154 to have increased frictional engagement with a shoelace, shoestring, or lace cord 180. In certain exemplary embodiments, the textured portion 249 comprises a series of substantially parallel grooves formed in an exterior surface of the cover exit slot 154. The textured portion 249 may be formed so as to be directional, allowing the lace cord 180 to slide comparatively smoothly relative to the textured portion 249, when moving in one direction, but be frictionally engaged by the textured portion 249, when urged in the opposite direction. Thus, the lace cord 180 can more easily pass along the textured portion 249 when urged in an insertion direction, but frictionally engage the textured portion 249 when urged in a withdrawing direction. As illustrated herein, the textured portion 249 may optionally be formed along a single surface of the cover exit slot 154. Alternatively, the textured portion 249 may optionally be for the long multiple surfaces of the cover exit slot 154.

FIGS. 39-50 illustrate certain elements and/or aspects of various exemplary embodiments of a lace lock assembly 200, according to the present disclosure. As illustrated in FIGS. 39-50, the lace lock assembly 200 comprises components and/or elements that correspond to and operate similarly to the similarly named and/or numbered components and/or elements of the lace lock assembly 100, as described with reference to FIGS. 1-38.

However, as illustrated in FIGS. 39-50, the lace lock assembly 200 includes a lace lock cover 250 having cover coupling posts 257. In various exemplary embodiments, the lace lock cover 250 includes cover coupling posts 257 extending from the lace lock cover 250. Generally, the size and shape of the lace lock cover 250 is dictated by the lace lock base 220, as the lace lock cover 250 is configured so as to allow the lace lock base 220 to be releasably attached or coupled to the lace lock cover 250.

As illustrated, each of four cover coupling posts 257 extends substantially perpendicular to a plane formed by the front surface of the lace lock cover 250. The size, shape, and position of each cover coupling post 257 is such that each cover coupling post 257 may be at least partially received within a corresponding post tunnel 127 of lace lock base 220. Thus, it should be appreciated that the number and placement of cover coupling posts 257 is a design choice and not limited by the description or illustrations of the present disclosure.

Each post tunnel 127 is formed through a portion of the base body 221 so as to allow at least a portion of a cover coupling post 257 to be removably received therein. In various exemplary embodiments, an inner diameter of a surface of each post tunnel 127 is formed so as to provide frictional engagement between an outer surface of each cover coupling post 257.

Thus, the base body 221 can be removably attached or coupled to the lace lock cover 250, via interaction of one or more corresponding cover coupling posts 257 and post tunnels 127. In a non-deployed configuration, the lace lock base 220 is attached or coupled to, for example, a boot 10 and the lace lock base 220 is removably attached or coupled to the lace lock cover 250. When the lace lock assembly 200 is in a deployed configuration, the lace lock base 220 is removed from the boot 10.

While the lace lock cover 250 is illustrated as being removably attached or coupled to the lace lock base 220 via interaction of one or more cover coupling posts 257 and post tunnels 127, it should be appreciated that the lace lock cover 250 may be removably or releasably attached or coupled to the lace lock base 220 via other means, such as, for example, a slidably releasable extensions and recesses, magnets, or other known or similar mating elements.

In various exemplary embodiments, an anchor loop 228 optionally extends from opposing end portions of the base body 221. Each anchor loop 228 includes an anchor loop aperture 229 formed through the respective anchor loop 228. It should be appreciated that the anchor loops 228 are optional and the lace lock base 220 may be formed without the anchor loops 228. In various exemplary embodiments, the anchor loops 228 and anchor loop apertures 229 may be used to attach or couple the lace lock base 220 to, for example, a boot 10.

A cover cam post 255 extends within the cover cavity 152. The cover cam post 255 is formed so as to be positioned within a cam lock aperture 142 of the cam lock 140, such that the cam lock 140 is rotatable or pivotable within the cover cavity 152, about the cover cam post 255.

A cam post recess 256 is formed in the cover cam post 255, which allows a fastener 160 to be positioned at least partially within the cam post recess 256. In various exemplary embodiments, the cam post recess 256 is internally threaded so as to interact with external threads of the fastener 160.

As further illustrated in FIGS. 39-50, the lace lock assembly 200 includes a lace lock base 220 having a base body 221 having a substantially planar surface 222 that does not include a base cavity 122. A base cam post 225 optionally extends from a portion of the substantially planar surface of the base body 221. If included, the base cam post 225 extends from the substantially planar surface 222 of the base body 221. The base cam post 225 is formed so as to be positioned within a cam lock aperture 142 of the cam lock 140, such that the cam lock 140 is rotatable or pivotable relative to the substantially planar surface 222, about the base cam post 225.

A cam post recess 226 is formed in the base cam post 225, which allows a fastener 160 to be positioned at least partially within the cam post recess 226. In various exemplary embodiments, the cam post recess 226 is internally threaded so as to interact with external threads of the fastener 160.

In various exemplary embodiments, the base cam post 225 extends such that when the lace lock base 220 is aligned with the lace lock cover 250, the base cam post 225 is aligned with the cover cam post 255 to allow the cam lock 140 to be rotatable or pivotable about the aligned base cam post 225 and cover cam post 255.

In various exemplary embodiments, a base entry aperture 227 is formed through the base body 221. If included, the base entry aperture 227 is formed so as to allow at least a portion of a shoelace, shoestring, or lace cord 180 can be repeatably slidably positioned therethrough.

FIGS. 51-60 illustrate certain elements and/or aspects of various exemplary embodiments of a lace lock assembly 300, according to the present disclosure. As illustrated in FIGS. 51-60, the lace lock assembly 300 comprises components and/or elements that correspond to and operate similarly to the similarly named and/or numbered components and/or elements of the lace lock assembly 100, as described with reference to FIGS. 1-38, and/or the lace lock assembly 200, as illustrated in FIGS. 39-50.

However, as illustrated in FIGS. 51-60, the coupling element 310 of the lace lock assembly 300 includes one or more base alignment projections 312 that extend from the coupling base 115. In various exemplary embodiments, two base alignment projections 312 extend from the coupling base 115, proximate opposing edge portions of the coupling base 115.

One or more base alignment recesses 322 are formed within portions of the base body 221 of the lace lock base 320. In various exemplary embodiments, two base alignment recesses 322 are formed so as to extend into portions of the base body 221, proximate opposing edge portions of the base body 221.

Each of the base alignment projections 312 of the coupling element 310 is formed so as to correspond to a respective base alignment recess 322 of the lace lock base 320. When the coupling element 310 is attached or coupled to the lace lock base 320, each of the base alignment projections 312 is aligned with and fitted at least partially within a respective base alignment recess 322 to assist in aligning the coupling element 310 with the lace lock base 320.

Figure 51:
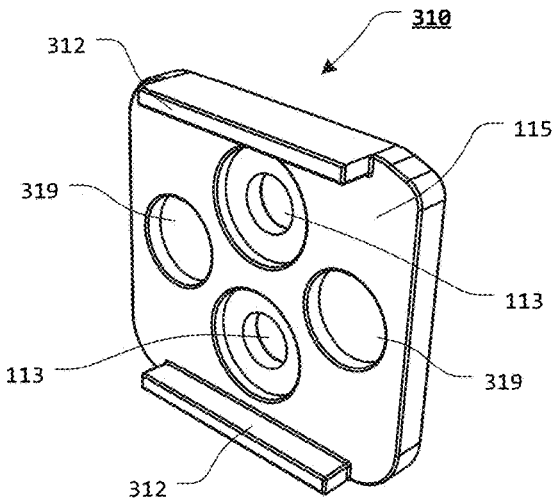
FIG. 51 illustrates a front perspective view of an exemplary embodiment of a coupling element of a lace lock assembly, according to the present disclosure.
Figure 52:
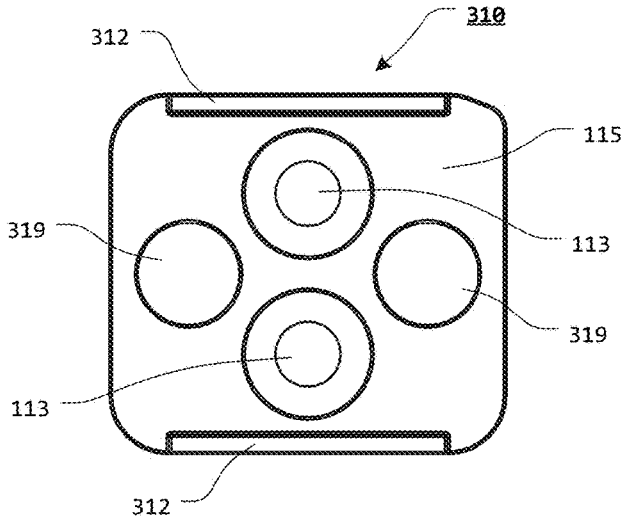
FIG. 52 illustrates a front view of an exemplary embodiment of a coupling element of a lace lock assembly, according to the present disclosure.
Figure 53:
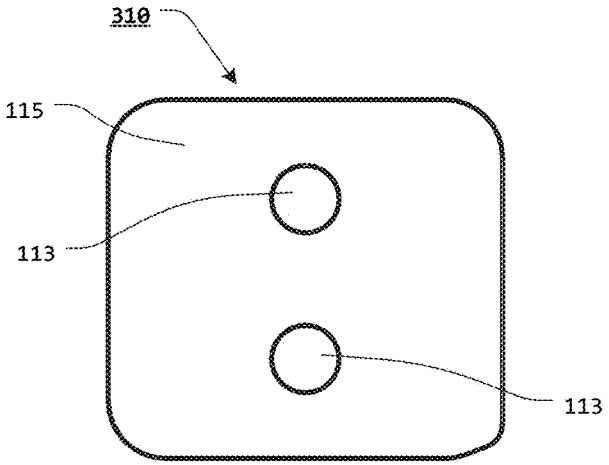
FIG. 53 illustrates a rear view of an exemplary embodiment of a coupling element of a lace lock assembly, according to the present disclosure.
Figure 54:
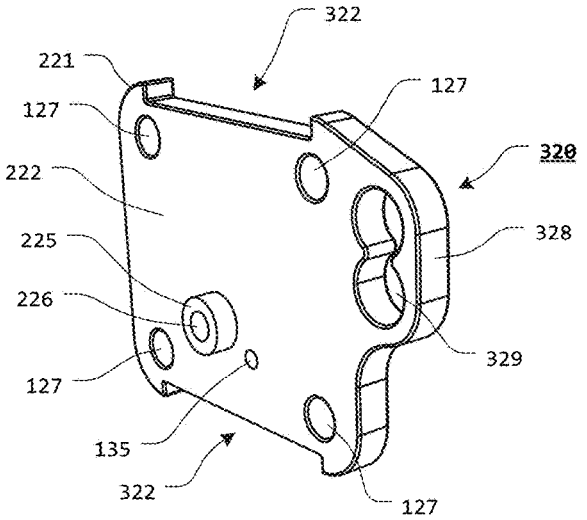
FIG. 54 illustrates a front perspective view of an exemplary embodiment of a lace lock base of a lace lock assembly, according to the present disclosure.
Figure 55:
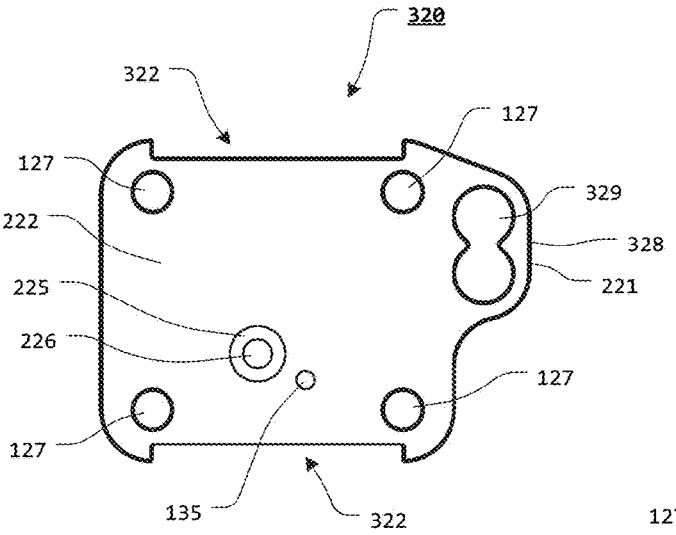
FIG. 55 illustrates a front view of an exemplary embodiment of a lace lock base of a lace lock assembly, according to the present disclosure.
Figure 57:
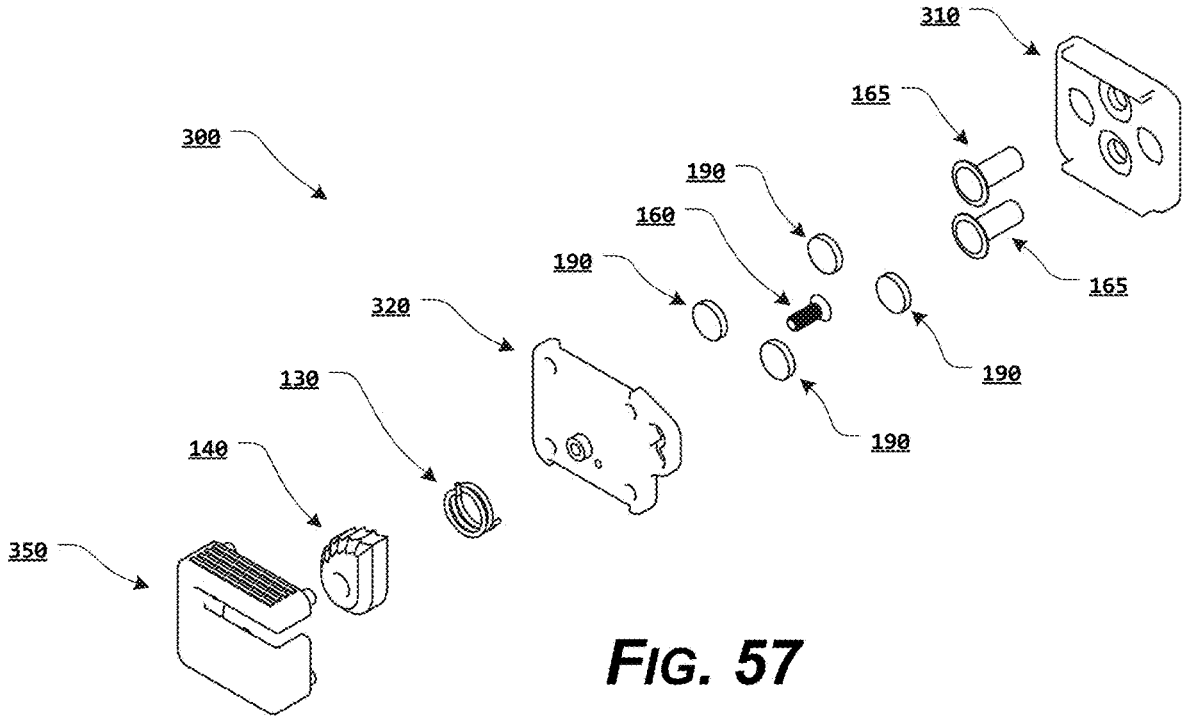
FIG. 57 illustrates an exploded front perspective view of certain exemplary components of an exemplary embodiment of a lace lock assembly, according to the present disclosure.
Figure 58:
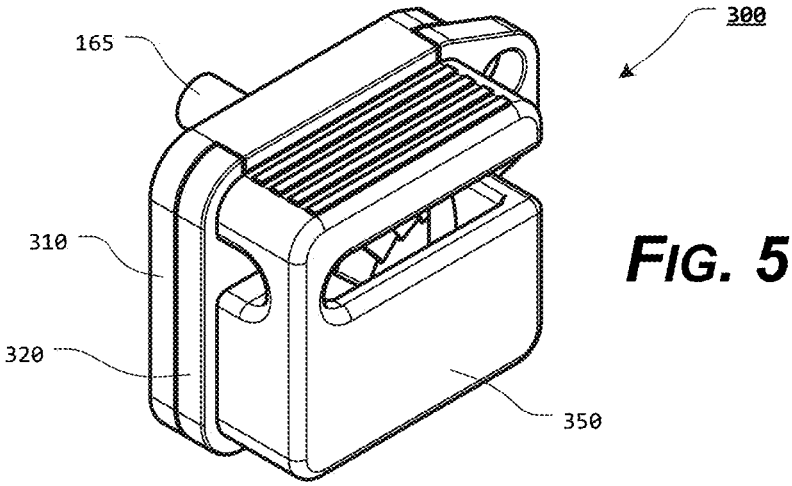
FIG. 58 illustrates an upper front perspective view of an exemplary embodiment of a lace lock assembly, according to the present disclosure.
Figure 59:
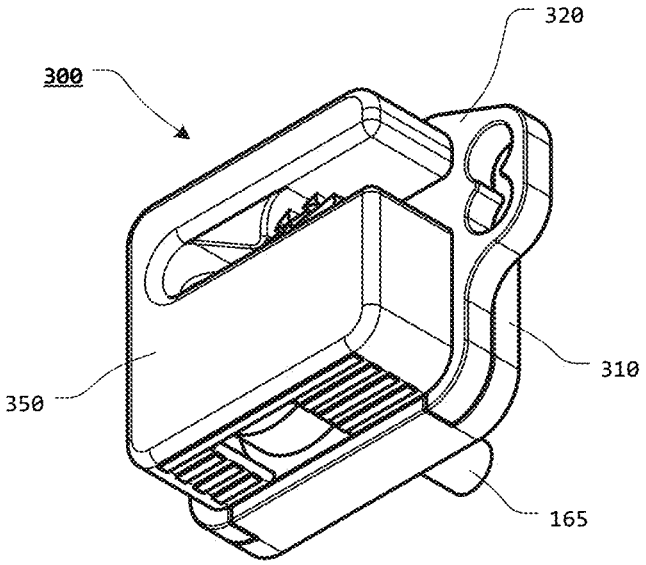
FIG. 59 illustrates a lower front perspective view of an exemplary embodiment of a lace lock assembly, according to the present disclosure.
Figure 60:
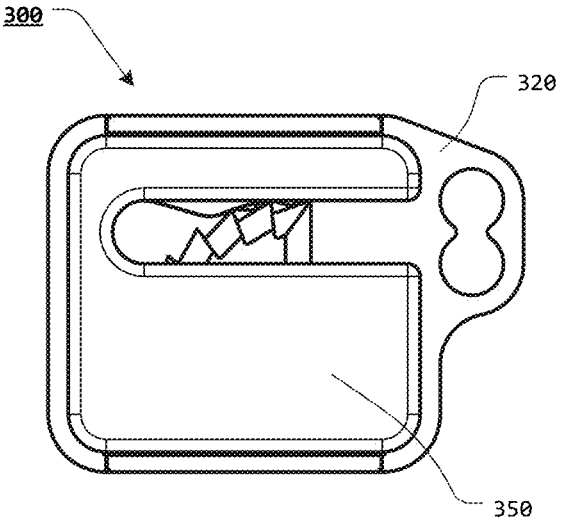
FIG. 60 illustrates a front view of an exemplary embodiment of a lace lock assembly, according to the present disclosure.

As illustrated in FIGS. 51, 52, and 57, the coupling element 310 of the lace lock assembly 300 includes one or more coupling element magnet recesses 319 formed therein. In various exemplary embodiments, the coupling element magnet recesses 319 are formed within the coupling base 115 of the coupling element 310. Each coupling element magnet recess 319 is formed so as to allow at least a portion of a magnet 190 to be fitted therein. In various exemplary embodiments, each coupling element magnet recess 319 is formed so as to allow at least a portion of a magnet 190 to be fitted therein such that a top surface of each magnet 190 is substantially flush with a surface of the coupling base 115.

Figure 56:
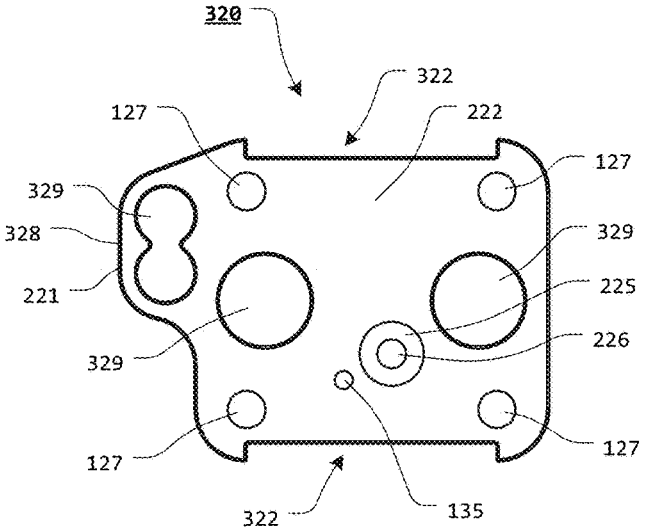
FIG. 56 illustrates a rear view of an exemplary embodiment of a lace lock base of a lace lock assembly, according to the present disclosure.

As illustrated in FIGS. 56 and 57, the lace lock base 320 of the lace lock assembly 300 includes one or more base magnet recesses 329 formed therein. In various exemplary embodiments, the base magnet recesses 329 are formed within the base body 221 of the lace lock base 320. Each base magnet recess 329 is formed so as to allow at least a portion of a magnet 190 to be fitted therein. In various exemplary embodiments, each base magnet recess 329 is formed so as to allow at least a portion of a magnet 190 to be fitted therein such that a top surface of each magnet 190 is substantially flush with a portion of the substantially planar surface 222 of the lace lock base 320.

The magnets 190 positioned within the coupling element magnet recesses 319 and the magnets 190 positioned within the base magnet recesses 329 are positioned such that when the lace lock base 320 is aligned with the coupling element 310, the lace lock base 320 and the coupling element 310 are magnetically attracted to one another, such that the lace lock base 320 is appropriately aligned with and releasably attached or coupled to the coupling element 310.

One or more base securing apertures 113 are formed within the coupling base 115, so as to allow a fastening element 165 to be positioned therethrough to attach or couple the coupling element 310 to a boot 10, shoe, or other item.

When the coupling element 310 is attached or coupled to, for example, a boot 10, via fastening elements 165, the attached or coupled lace lock cover 250 and lace lock base 320 can be selectively removed from the coupling element, to be utilized, for example, as a tourniquet.

In various exemplary embodiments, an anchor loop 328 optionally extends from the base body 221. The anchor loop 328 includes an anchor loop aperture 329 formed therethrough. As illustrated, the anchor loop aperture 329 may be formed of a compound or "FIG. 8" type aperture.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A lace lock assembly, comprising:

a lace lock base, wherein a base cavity is formed within at least a portion of said lace lock base, wherein a cam post extends within a portion of said lace lock base;

a cam lock positioned within a base cavity of said lace lock base, wherein said cam lock is at least partially rotatable about at least a portion of said cam post between an engaged position and a disengaged position, and wherein said cam lock is biased to said engaged position;

a lace lock cover, wherein said lace lock cover covers at least a portion of said lace lock base, and wherein at least a portion of a fastener is positioned through a fastener aperture of said lace lock cover to engage a cam post recess of said cam post and maintain said lace lock cover in a position relative to said lace lock base;

a lace cord, wherein a distal end portion of said lace cord is attached or coupled to said lace lock base, wherein a proximal end portion of said lace cord is positioned through at least a portion of said lace lock base so as to selectively engage said cam lock if said cam lock is in said engaged position, and wherein if said cam lock is in said engaged position, interaction between at least a camming surface of said cam lock resists a withdrawing force of said lace cord from said lace lock base; and a coupling element, wherein said lace lock base is repeatably releasably attachable or couplable to said coupling element.

2. The lace lock assembly of claim 1, wherein said cam lock is biased to said engaged position via a torsion spring.

3. The lace lock assembly of claim 1, wherein said coupling element is attached or coupled to an item of footwear.

4. The lace lock assembly of claim 1, wherein said coupling element is repeatably releasably attachable or couplable to said lace lock base via interaction of one or more post tunnels formed through a portion of said base body and at least a portion of one or more corresponding coupling posts extending from a portion of said coupling element.

5. The lace lock assembly of claim 1, wherein at least a portion of a camming surface of said cam lock includes a textured portion.

6. A lace lock assembly, comprising:

a lace lock base;

a lace lock cover, wherein a cover cavity is formed in a portion of said lace lock cover, wherein a cam post extends within a portion of said cover cavity, wherein a cover exit slot is formed through a portion of a front wall of said lace lock cover and through a portion of a first sidewall of said lace lock cover, wherein a cover entry aperture is formed through a portion of a second sidewall of said lace lock cover, and wherein said lace lock cover covers at least a portion of said lace lock base;

a cam lock positioned within said cover cavity of said lace lock cover, wherein said cam lock is at least partially rotatable about at least a portion of said cam post between an engaged position and a disengaged position;

a lace cord, wherein a distal end portion of said lace cord is attached or coupled to said lace lock base, wherein a proximal end portion of said lace cord is positioned through at least a portion of said lace lock base so as to selectively engage said cam lock if said cam lock is in said engaged position, and wherein if said cam lock is in said engaged position, interaction between at least a camming surface of said cam lock resists a withdrawing force of said lace cord from said lace lock base; and a coupling element, wherein said lace lock base is repeatably releasably attachable or couplable to said coupling element.

7. The lace lock assembly of claim 6, wherein said coupling element is attached or coupled to an item of footwear.

8. The lace lock assembly of claim 6, wherein at least a portion of a camming surface of said cam lock includes a textured portion.

9. The lace lock assembly of claim 6, wherein a torsion spring biases said cam lock to said engaged position.

10. The lace lock assembly of claim 6, wherein at least a portion of a fastener is positioned through a fastener aperture of said lace lock base to engage a cam post recess of said cam post and maintain said lace lock cover in a position relative to said lace lock base.

11. The lace lock assembly of claim 6, wherein said lace lock cover is removably attached or coupled to said lace lock base via interaction of one or more cover coupling posts extending from said lace lock cover and one or more corresponding post tunnels formed within said lace lock base.

12. The lace lock assembly of claim 6, wherein one or more magnets are attached or coupled to said coupling element and wherein one or more corresponding magnets are attached or coupled to said lace lock base, wherein said one or more magnets of said coupling element and said one or more corresponding magnets of said lace lock base are positioned such that if said lace lock base is appropriately aligned with said coupling element, said lace lock base and said coupling element are magnetically releasably attached or coupled to one another.

13. A lace lock assembly, comprising:

a lace lock base;

a lace lock cover having a cover cavity formed in a portion of said lace lock cover, a cover cam post extending within a portion of said cover cavity, and said lace lock cover position so as to cover at least a portion of said lace lock base;

a cam lock positioned within said cover cavity of said lace lock cover, said cam lock at least partially rotatable about at least a portion of said cover cam post between an engaged position and a disengaged position;

a lace cord having a distal end portion attached or coupled to said lace lock base, having a proximal end portion positioned through at least a portion of said lace lock base so as to selectively engage said cam lock if said cam lock is in said engaged position such that if said cam lock is in said engaged position, interaction between at least a camming surface of said cam lock resists a withdrawing force of said lace cord from said lace lock base; and a coupling element repeatably releasably attachable or couplable to said lace lock base.

14. The lace lock assembly of claim 13, wherein said coupling element is attached or coupled to an item of footwear.

15. The lace lock assembly of claim 13, wherein at least a portion of a camming surface of said cam lock includes a textured portion.

16. The lace lock assembly of claim 13, wherein said cam lock is biased to said engaged position.

17. The lace lock assembly of claim 13, wherein a base cam post extends from said base body, wherein said base cam post extends such that when said lace lock base is aligned with said lace lock cover, said base cam post is aligned with said cover cam post to allow said cam lock to be rotatable or pivotable about a portion of said aligned base cam post and about a portion of said cover cam post.

18. The lace lock assembly of claim 13, wherein said lace lock cover is removably attached or coupled to said lace lock base via interaction of one or more cover coupling posts extending from said lace lock cover and one or more corresponding post tunnels formed within said lace lock base.

19. The lace lock assembly of claim 13, wherein one or more magnets are attached or coupled to said coupling element and wherein one or more corresponding magnets are attached or coupled to said lace lock base, wherein said one or more magnets of said coupling element and said one or more corresponding magnets of said lace lock base are positioned such that if said lace lock base is appropriately aligned with said coupling element, said lace lock base and said coupling element are magnetically releasably attached or coupled to one another.

20. The lace lock assembly of claim 13, wherein a cover exit slot is formed through a portion of a front wall of said lace lock cover and extends through a portion of a first sidewall of said lace lock cover, and wherein a cover entry aperture is formed through a portion of a second sidewall of said lace lock cover.

* * * * *